US010889397B2

(12) United States Patent
Rea et al.

(10) Patent No.: US 10,889,397 B2
(45) Date of Patent: Jan. 12, 2021

(54) UNIT AND METHOD FOR FILLING CONTAINERS OF SINGLE-USE CAPSULES FOR EXTRACTION OR INFUSION BEVERAGES

(71) Applicant: GIMA S.p.A., Bologna (IT)

(72) Inventors: Dario Rea, Bologna (IT); Pierluigi Castellari, Bologna (IT); Davide Baraccani, Ravenna (IT)

(73) Assignee: I.M.A. INDUSTRIA MACCHINE AUTOMATICHE S.P.A., Bologna (IT)

( * ) Notice: Subject to any disclaimer, the term of this patent is extended or adjusted under 35 U.S.C. 154(b) by 609 days.

(21) Appl. No.: 15/324,541

(22) PCT Filed: Aug. 3, 2015

(86) PCT No.: PCT/IB2015/055877
§ 371 (c)(1),
(2) Date: Jan. 6, 2017

(87) PCT Pub. No.: WO2016/020822
PCT Pub. Date: Feb. 11, 2016

(65) Prior Publication Data

US 2017/0203864 A1 Jul. 20, 2017

(30) Foreign Application Priority Data

Aug. 6, 2014 (IT) ..... BO2014A0447

(51) Int. Cl.
*B65B 29/02* (2006.01)
*B65B 1/04* (2006.01)
(Continued)

(52) U.S. Cl.
CPC ..... *B65B 29/02* (2013.01); *B65B 1/36* (2013.01); *B65B 29/022* (2017.08); *B65B 63/022* (2013.01); *B65D 85/8043* (2013.01)

(58) Field of Classification Search
CPC ..... B65B 29/02; B65B 29/022; B65B 63/022; B65B 39/007; B65B 65/02; B65B 1/36;
(Continued)

(56) References Cited

U.S. PATENT DOCUMENTS 2,330,361 A * 9/1943 Howard ..... B65B 9/087 53/455
2,366,811 A * 1/1945 Sibson, Jr. ..... B65B 1/36 141/101
(Continued)

FOREIGN PATENT DOCUMENTS

CN 1829632 A 9/2006
CN 101061036 A 10/2007
(Continued)

OTHER PUBLICATIONS

Chinese Office Action for corresponding Patent Application No. 201580042038.8 dated Jun. 4, 2018.
(Continued)

*Primary Examiner* — Thomas M Wittenschlaeger
(74) *Attorney, Agent, or Firm* — Renner, Otto, Boisselle & Sklar, LLP

(57) ABSTRACT

Described is a unit for filling containers (2) forming single-use capsules (3) with a dose (33) of product for extraction or infusion beverages, comprising: a line (4) for transport of the containers (2); a station (SR) for filling the containers (2) with a dose (33) of product and comprising: a first containing seat (S1) designed to receive a dose (33) of product; a device (10) for moving the first seat (S); a device (11) for adjusting the position of the first containing seat (S1) between a position (P1) for receiving the dose and a position (P2) for releasing the dose; a substation (ST1) for forming the dose (33) inside the first containing seat (S1); a substation (ST3) for releasing the dose (33) of product from the first containing seat (S1) to a container (2) transported by the
(Continued)

transport line (4), the adjusting device (11) being configured to place the first containing seat (S1) in the receiving position (P1) at the substation (ST1) for forming the dose (33) and in the release position (P2) at the substation (ST3) for releasing the dose (33).

22 Claims, 17 Drawing Sheets

(51) Int. Cl.

| | |
|---|---|
| ***B65B 39/00*** | (2006.01) |
| ***B65B 43/60*** | (2006.01) |
| ***B65B 65/02*** | (2006.01) |
| ***B65B 7/16*** | (2006.01) |
| ***B65D 85/804*** | (2006.01) |
| ***B65B 1/36*** | (2006.01) |
| ***B65B 63/02*** | (2006.01) |

(58) Field of Classification Search
CPC .... B65B 1/04; B65B 1/10; B65B 1/12; B65B 1/14; B65B 1/363; B65B 1/24; B65B 7/16; B65B 43/60; B65B 3/08; B65B 3/305; B65B 37/10; B65B 37/12; B65D 85/8043
See application file for complete search history.

(56) References Cited

U.S. PATENT DOCUMENTS

| | | | | | |
|---|---|---|---|---|---|
| 2,567,052 | A * | 9/1951 | Carruthers | B65B 63/022 | 100/178 |
| 2,973,609 | A * | 3/1961 | Morgan, Jr. | B65B 31/02 | 141/234 |
| 3,112,777 | A * | 12/1963 | Lohse | B65B 43/60 | 141/166 |
| 4,061,164 | A * | 12/1977 | Sato | B65B 1/36 | 141/152 |
| 4,590,977 | A * | 5/1986 | Schmidt | B65B 1/12 | 141/129 |
| 4,754,785 | A * | 7/1988 | Eisenberg | B65B 1/363 | 141/1 |
| 4,771,915 | A * | 9/1988 | Cand | A21C 9/04 | 222/56 |
| 4,991,632 | A * | 2/1991 | Nordmeyer | B65B 1/36 | 141/1 |
| 5,041,297 | A * | 8/1991 | Dowaliby | B65B 1/36 | 141/146 |
| 5,409,137 | A * | 4/1995 | Bonomelli | B65B 29/028 | 222/56 |
| 5,687,551 | A * | 11/1997 | Mustain | B65B 1/32 | 141/10 |
| 5,791,127 | A | 8/1998 | Rossi | | |
| 7,367,172 | B2 * | 5/2008 | Conti | B65B 9/213 | 53/553 |
| 7,661,248 | B2 * | 2/2010 | Conti | B65B 1/366 | 53/529 |
| 8,539,743 | B2 * | 9/2013 | Rapparini | B65B 9/042 | 53/561 |
| 9,352,859 | B2 * | 5/2016 | Librio | B65B 1/366 | |
| 9,708,134 | B2 * | 7/2017 | Rea | B65B 29/02 | |
| 2002/0046551 | A1 * | 4/2002 | Tisma | B65B 43/60 | 53/506 |
| 2006/0260274 | A1 * | 11/2006 | Rea | B65B 1/385 | 53/122 |
| 2008/0283144 | A1 * | 11/2008 | Rapparini | B30B 11/12 | 141/73 |
| 2011/0016834 | A1 * | 1/2011 | Rapparini | B65B 9/042 | 53/510 |
| 2011/0094621 | A1 * | 4/2011 | Kawanishi | B65B 1/32 | 141/94 |
| 2012/0151874 | A1 * | 6/2012 | Solano | B65B 43/04 | 53/268 |
| 2012/0210675 | A1 * | 8/2012 | Murray | B65B 31/042 | 53/403 |
| 2014/0000758 | A1 * | 1/2014 | Kuhn | B65B 31/045 | 141/37 |

FOREIGN PATENT DOCUMENTS

| | | | |
|---|---|---|---|
| CN | 101687556 | A | 3/2010 |
| WO | 92/20579 | A1 | 11/1992 |
| WO | 01/34475 | A1 | 5/2001 |
| WO | WO 01/34475 | A1 | 5/2001 |
| WO | 2013/144837 | A1 | 10/2013 |
| WO | WO 2013/144837 | A1 | 10/2013 |

OTHER PUBLICATIONS

International Search Report and Written Opinion for corresponding Patent Application No. PCT/IB2015/055877 dated Oct. 27, 2015.
Search Report for corresponding Italian Patent Application No. B020140447 dated Mar. 25, 2015.

* cited by examiner

UNIT AND METHOD FOR FILLING CONTAINERS OF SINGLE-USE CAPSULES FOR EXTRACTION OR INFUSION BEVERAGES

This application is a national phase of International Application No. PCT/IB2015/055877 filed Aug. 3, 2015 and published in the English language, which claims priority to Italian Patent Application No. B02014A000447 filed Aug. 6, 2014, which are hereby incorporated herein by reference in their entirety.

TECHNICAL FIELD

This invention relates to a unit and a method for filling containers with a dose of product. Advantageously, the containers may define single-use capsules for extraction or infusion beverages.

BACKGROUND ART

The prior art capsules, used in machines for making extraction or infusion beverages, comprise in their simplest form, the following:

- a rigid, cup-shaped outer container comprising a perforatable or perforated bottom and an upper aperture provided with a rim (and usually, but not necessarily, having the shape of a truncated cone);
- a dose of product for extract or infusion beverages contained in the outer container;
- and a length of sheet obtained from a web for sealing (hermetically) the aperture of the rigid container and designed (usually but not necessarily) to be perforated by a nozzle which supplies liquid under pressure.

Usually, but not necessarily, the sealing sheet is obtained from a web of flexible material.

In some cases, the capsules may comprise one or more rigid or flexible filtering elements.

For example, a first filter (if present) may be located on the bottom of the rigid container. A second filter (if present) may be interposed between the piece of sealing sheet and the product dose.

The dose of product may be in direct contact with the rigid, cup-shaped outer container, or with a filtering element.

The capsule made up in this way is received and used in specific slots in machines for making beverages.

In the technical sector in question, the need is particularly felt for filling in a simple and effective way the rigid, cup-shaped containers or the filtering elements whilst at the same time maintaining a high productivity.

It should be noted that, in this regard, there are prior art packaging machines having a filling unit which allows the simultaneous filling of several parallel rows of rigid, cup-shaped containers, which are advancing. In this case, each row of rigid, cup-shaped containers is associated with a dedicated filling device, generally equipped with a screw feeder to allow the descent of the product inside the container.

This type of unit is therefore obviously quite expensive and complex, since it comprises a plurality of devices and drives (one for each screw device) which are independent from each other and which must necessarily be coordinated.

Moreover, the overall reliability of the machine resulting from this configuration/arrangement of elements is necessarily limited because the rate of faults is inevitably linked with the number of devices and drives present.

A strongly felt need by operators in this sector is that of having a unit and a method for filling containers (rigid, cup-shaped containers, or filtration elements) forming single-use capsules for extraction or infusion beverages which are particularly simple, reliable and inexpensive and at the same time maintain a high overall productivity.

DISCLOSURE OF THE INVENTION

The aim of this invention is therefore to satisfy the above-mentioned need by providing a unit and a method for filling containers (rigid, cup-shaped containers) forming single-use capsules for extraction or infusion beverages which can be made relatively simply and inexpensively and which is particularly reliable.

Another aim of the invention is to provide a machine for packaging single-use capsules for extraction or infusion beverages which can guarantee a high productivity.

A further aim is to provide a unit and a method of filling single-use capsules for extraction or infusion beverages for filling the cup-shaped containers which reduce the variability of the weight of product introduced into the cup-shaped containers.

BRIEF DESCRIPTION OF DRAWINGS

The technical features of the invention, with reference to the above aims, are clearly described in the claims below and its advantages are apparent from the detailed description which follows, with reference to the accompanying drawings which illustrate a non-limiting example embodiment of the invention and in which:

DETAILED DESCRIPTION OF PREFERRED EMBODIMENTS OF THE INVENTION

Figure 1:
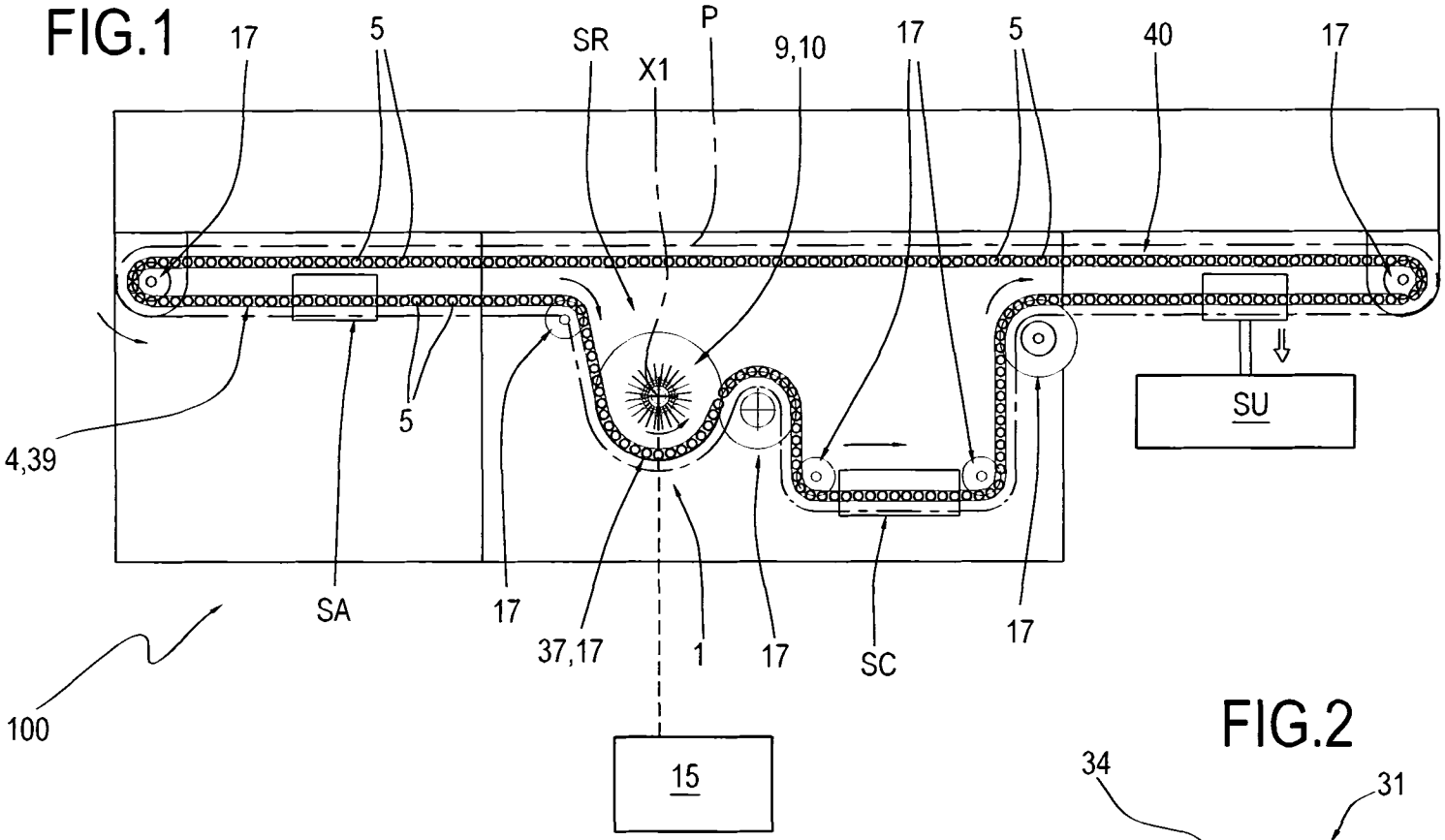
FIG. 1 is a schematic view of a machine for packaging containing elements forming single-use capsules for extraction or infusion beverages comprising a filling unit according to the invention.

With reference to the accompanying drawings, the numeral 1 denotes a unit for filling containers 2 forming single-use capsules 3 for extraction or infusion beverages, with a dose 33 of solid product in powder, granules or leaves, such as coffee, tea, milk, chocolate, or combinations of these.

The filling unit 1 is particularly suitable for filling containers 2 forming single-use capsules 3 with products in powder, preferably coffee.

Figure 2:
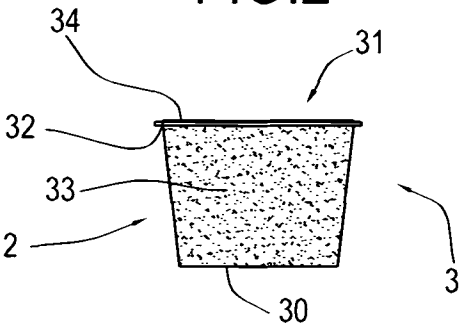
FIG. 2 is a schematic view of a single-use capsule for beverages which can be made by the machine of FIG. 1.

More specifically, as illustrated in FIG. 2, the single-use capsules 3 for extraction or infusion beverages comprise, in a minimum, but non-limiting, embodiment: a rigid, cup-shaped container 2 (usually to define a frustoconical shape) comprising a base 30 and an upper opening 31 equipped with a collar 32; a dose 33 of extraction or infusion product contained in the rigid container 2 and a lid 34 for closing the upper opening 31 of the rigid container 2.

The capsule 3 may comprise one or more filtering or product retaining elements (not illustrated here for simplicity reasons).

In the capsule 3 illustrated in FIG. 2, the rigid, cup-shaped body 2 defines the container to be filled with a dose 33 of product.

Other types of capsules may be filled with the filling unit according to the invention, for example capsules wherein the dose 33 of product is contained in, and retained by, a filtering element connected to the rigid container, wherein the rigid container can be closed at the bottom, or open.

In other words, in capsules not illustrated, a filtering element may contain and retain the dose 33 of product, forming the container in combination with the rigid body with which it is coupled.

In the following description, reference will be made to the rigid, cup-shaped body 2 as the container, but it is understood that the invention can be made with reference to capsules wherein the container is formed by a filtering element (or other components of the capsule designed to contain a dose 33 of product) and by the respective rigid body to which it is connected.

It should be noted that the filling unit 1 comprises a line 4 for transport (that is to say, movement) of rigid, cup-shaped containers 2 designed to contain a predetermined quantity of extraction or infusion product (dose 33) and a filling station SR.

The transport line 4 extends along a first movement path P and is provided with a plurality of seats 5 for supporting the rigid containers 2, arranged in succession along the first path P. Preferably, the first movement path P is a closed path lying on a horizontal plane.

The supporting seats 5 are arranged one after another, not necessarily continuously. In addition, the supporting seats 5 each have a corresponding vertical axis of extension.

The transport line 4 comprises a transport element 39 to which the supporting seats 5 are connected to be moved along the first path P.

The transport element 39 is closed in a loop around movement means 17 which rotate about vertical axes for moving the transport element 39.

Preferably, the transport element 39 is a chain 40 comprising a plurality of links, hinged to one another in succession about corresponding vertical axes, to form an endless loop.

At least one of the links comprises at least one supporting seat 5 with a vertical axis for corresponding rigid container 2 which can be positioned with the opening 31 facing upwards.

It should be noted that the chain 40 may comprise both links having a corresponding supporting seat 5 and connecting links which are not provided with supporting seats 5 and which are interposed between links provided with supporting seats 5. Therefore, preferably, a certain number of links comprises each supporting seat 5.

Alternatively, in an embodiment not illustrated, the transport element 39 may comprise a flexible belt to which the supporting seats 5 for the rigid containers 2 are fixed.

Preferably, but not necessarily, the movement means 17 rotate continuously about vertical axes to allow the transport element 39 to move continuously.

Described below is the station SR for filling the rigid, cup-shaped containers 2.

The station SR for filling the rigid, cup-shaped containers 2 comprises:

- at least one first containing seat S1 (hereinafter referred to as first seat S1 or also as a first receiving seat S1) designed to receive a dose 33 of product;
- a device 10 for moving the first seat S1 along a closed path PS;
- a device 11 for adjusting the position of the first seat S1, configured for adjusting the position of the first seat S1 along the closed path PS, between a position P1 for receiving the dose 33 and a position P2 for releasing the dose 33 inside one of the containers 2;
- a substation ST1 for forming the dose 33 inside the at least one first containing seat S1, provided with a device 6 for releasing a predetermined quantity of product forming the dose 33 inside the at least one first containing seat S1 located in the position P1 for reception of the dose;
- a substation ST3 for releasing the dose 33 of product from the at least one containing seat S1 positioned in the position P2 for releasing the dose to a container 2 transported by the transport line 4.

Figure 3:
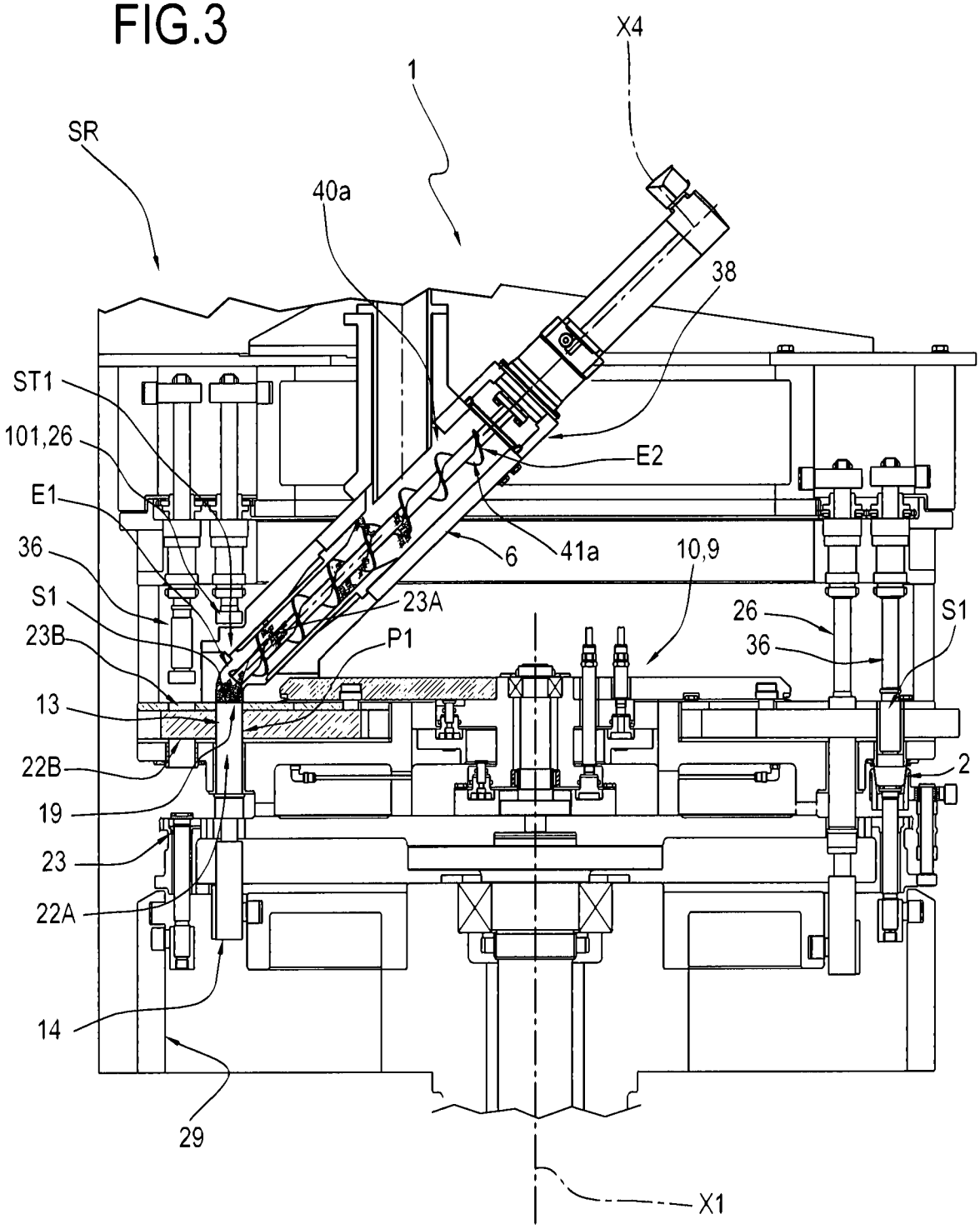
FIG. 3 is a schematic side view of the filling unit present in the machine according to the invention, of FIG. 1.
Figure 4:
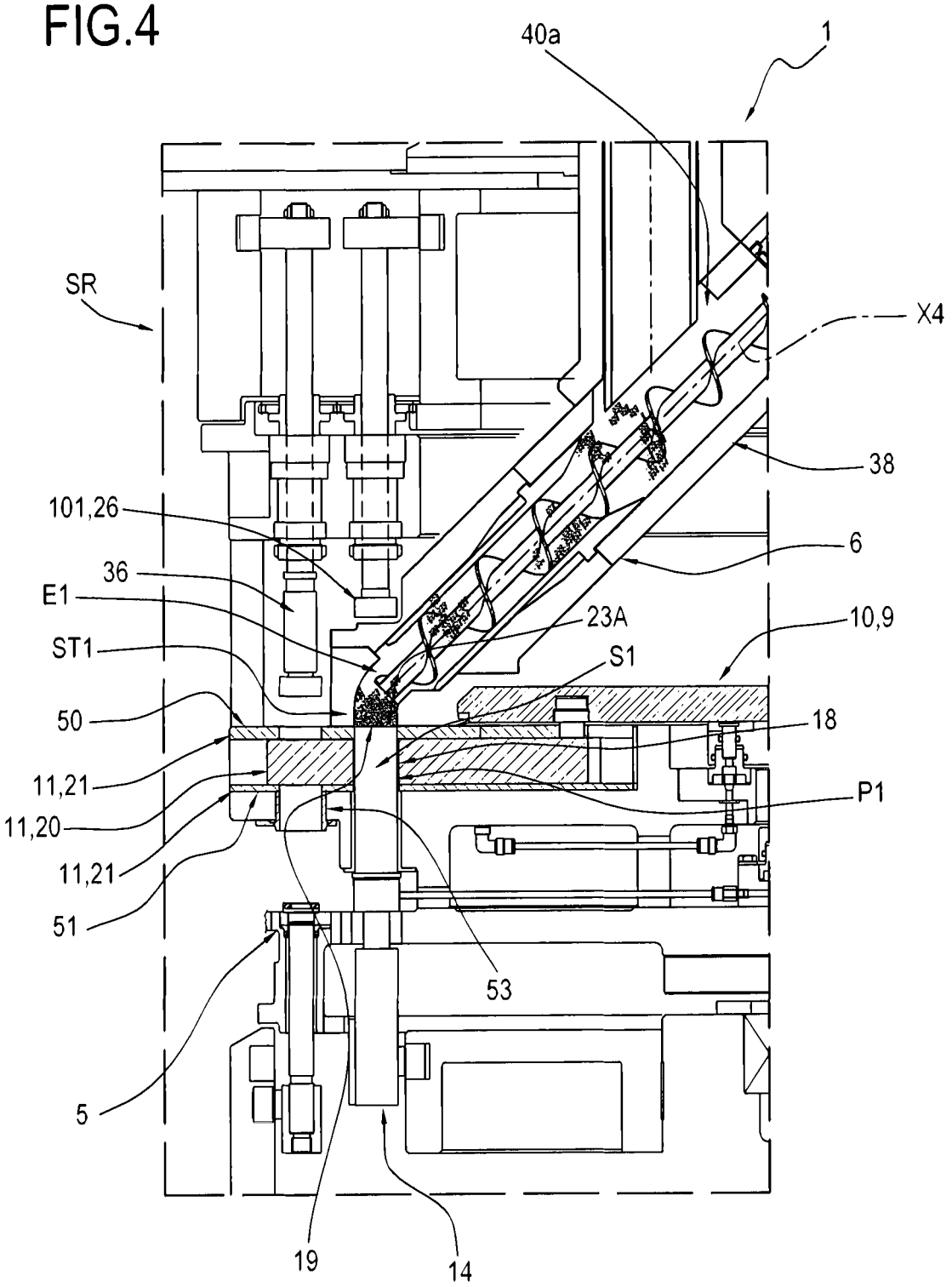
FIGS. 4 to 8 show respective side views partly in cross section of the filling unit of FIG. 3 according to different operating steps.
Figure 5:
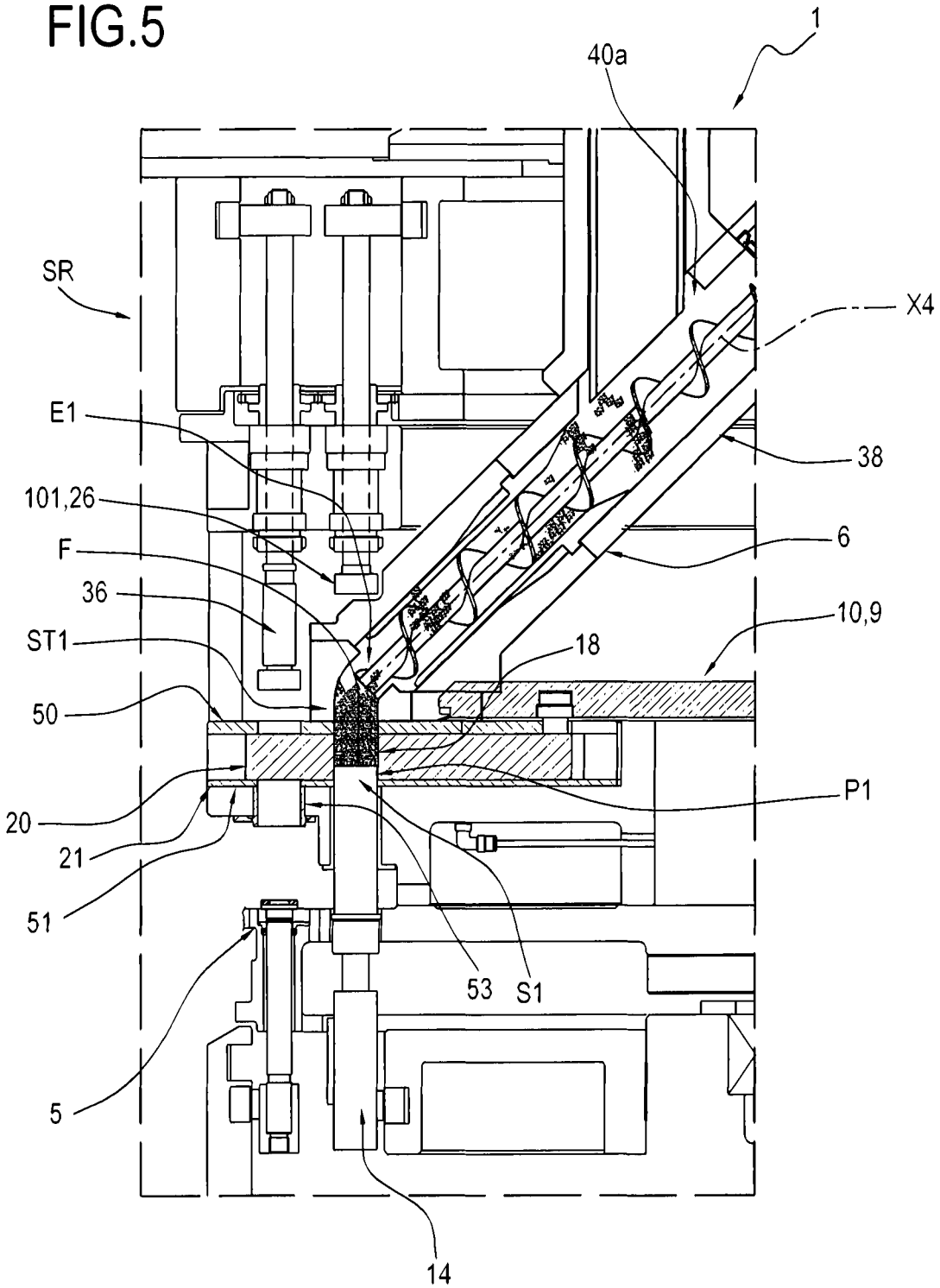

It should be noted that for reasons of clarity, only part of the product in the release device 6 is illustrated in FIGS. 3 to 5. In reality, the release device 6 is, in operating conditions, normally full of product to be dosed.

The device 11 for adjusting the position is configured to place the at least one first seat S1 in the position P1 for receiving at the substation ST1 for forming the dose 33 and in the position P2 for releasing the dose at the substation ST3 for releasing the dose 33.

All the above-mentioned components forming part of the filling station SR of the rigid, cup-shaped containers 2 are described below in more detail, with particular reference to the accompanying drawings.

It should be noted that the device 10 for moving the first containing seat S1 comprises a first element (or device) 9 rotating about a first axis X1 of rotation which is substantially vertical, on which is connected the first containing seat S1 to be rotated about the first vertical axis X1 of rotation.

Preferably, the first rotary element 9 comprises a wheel, connected to respective means for driving the rotation (for example, connected to a drive unit, not illustrated here).

More specifically, preferably, the filling station SR comprises a plurality of first seats S1.

The first seats S1 are connected radially to the first rotary element 9 to be rotated with it. Preferably, the first seats S1 are positioned along an arc of a circle of the rotary element 9, even more preferably they are positioned along the entire circumference having as the centre a point of the first axis X1.

Still more preferably, the first seats S1 are angularly equispaced from each other along a circumference having as the centre a point of the first axis X1.

It should be noted that each first seat S1 is moved by the first rotary element 9 in rotation so as to engage cyclically—during the rotation—the substations for forming ST1 and releasing ST3 the dose.

In the embodiment illustrated in the accompanying drawings, the first containing seats S1 are supported by the first rotary element 9 in a radially movable fashion.

According to this aspect, the adjustment device 11 is configured to move the at least one first seat S1 radially relative to the first axis X1 of rotation between the position P1 for receiving the dose and the position P2 for releasing the dose.

More specifically, the adjustment device 11 is configured to move the at least one first seat S1 radially in a forward stroke from the position P1 for receiving the dose to the position P2 for releasing the dose and according to a return stroke from the position P2 for releasing the dose to the position P1 receiving the dose.

In the embodiment illustrated, the first seat S1 is formed in an element 20 for containing the dose (preferably having an elongate shape).

Preferably, the first seat S1 is a through seat.

In other words, preferably the first through seat S1 extends between an upper face and a lower face of the above-mentioned element 20 for containing the dose.

Preferably, the first seat S1 has a cylindrical shape, that is, it has a circular cross section.

According to another aspect, the filling unit 1 comprises an element 21 for housing the element 20 for containing the dose, provided with upper openings 23A, 23B and lower openings 22A, 22B.

Preferably, the housing element 21 is fixed to the rotary element 9, in such a way as to be rotated by the rotary element without the position being modified.

In practice, the housing element 21 defines a housing cavity, inside of which the element 20 for containing the dose is movably inserted to be movable between the position P1 for receiving the dose and the position P2 for releasing the dose.

Advantageously, the containing element 20 is movable on a horizontal plane.

A rotation of the rotary element 9 determines a rotation of the containing 21 and housing 20 elements about the first axis X1 of rotation.

The filling unit 1 also comprises a track, or cam, 57 having side walls 11A, 11B facing each other. The track 57 extends on a closed-loop path.

The element 20 for containing the dose is configured for engaging in the track 57 in such a way that the position of the element 20 for containing the dose along the closed path PS can be adjusted.

It should be noted that the track 57 is fixed relative to the frame 29 of the filling unit 1, that is, it is not rotated as one with the rotary element 9.

In practice, it should be noted that the element 20 for containing the dose is equipped with a portion, or cam follower, 20*a* designed to be inserted in the track 57.

It should be noted that the portion 20*a* and the track 57 define, in combination, a cam device configured for adjusting the position of the first seat S1 along the closed path PS.

It should also be noted that the containing element 20, the housing element 21 and the cam device (20*a*, 57) define the above-mentioned device 11 for adjusting the position of the first seat S1 along the closed path PS.

It should also be noted that the housing element 21 comprises an upper wall 50, provided with a first upper opening 23A and a second upper opening 23B.

The first upper opening 23A is located in a position close to the axis X1, whilst the second upper opening 23B is located in a position far from the axis X1.

The housing element 21 also comprises a lower wall 51, provided with a first lower opening 22A and a second lower opening 22B.

The first lower opening 22A is located in a position close to the axis X1, whilst the second lower opening 22B is located in a position far from the axis X1.

Preferably, the first upper opening 23A is vertically superposed on the first lower opening 22A. Preferably, the second upper opening 23B is vertically superposed on the second lower opening 22B.

The first and second openings 22A, 22B, 23A, 23B, are in communication with the housing cavity defined by the housing element 21 and inside of which the containing element 20 can move radially.

The containing element 20, therefore the first seat S1, is movable in such a way as to be positioned:

- in the first position P1 for receiving the dose 33, in a condition of vertical alignment with the first upper opening 23A and the first lower opening 22A, and
- in the second position P2 for receiving the dose 33, in a condition of vertical alignment with the second upper opening 23B and the second lower opening 22B.

In other words, when the first seat S1 is positioned vertically aligned with the first upper openings 23A and lower openings 22A, the first seat S1 is in the position P1 for receiving the dose, whilst when first seat S1 is positioned vertically aligned with the second upper openings 23B and lower openings 22B the first seat S1 is in the position P2 for releasing the dose 33.

Each first seat S1 is defined, preferably, by lateral walls of a cavity 18 and by a bottom wall F (the bottom wall F is a movable wall, that is to say, it may be defined by one or more elements as a function of the position of the first seat).

Preferably, the cavity 18 is a cylindrical cavity.

Furthermore, still more preferably, the cavity 18 has a vertical axis of extension (parallel to the first axis X1 of rotation).

Again, preferably, the filling station SR comprises, for each first seat S1:

- a first piston 13, which is movable between a lower position and an upper position and forming the above-mentioned bottom wall F of the first seat S1 when the first seat S1 is in the position P1 for receiving the dose;
- means 14 for moving the first piston 13 for moving the first piston 13 between the lower and upper positions in such a way as to adjust the volume inside the first seat S1.

Examples of movement means 14 are electric motors, pneumatic devices, cam devices, and other prior art devices.

Preferably, but not necessarily, the filling station SR comprises movement means 14 which are independent for each first piston 13, so that each piston 13 can be moved independently of the others.

It should be noted that each first piston 13 is rotated by the rotary element 9.

More specifically, the first pistons 13 are positioned in a predetermined radial position relative to the axis X1 of the rotary element 13.

According to another aspect, the filling unit 1 comprises a control unit 15, designed to control one or more moving elements of the unit.

The control unit 15 is configured to control, when the first seat S1 is positioned at the substation ST1 for forming the dose, the movement of the first piston 13 to place it in a predetermined position corresponding to a desired internal volume of the first seat S1.

In practice, as described in more detail below, the first piston 13 is positioned at a predetermined height, so that the first seat S1 has a predetermined and desired internal volume (which is filled by a predetermined quantity of product).

It should also be noted that the first piston 13 defines the bottom F of the first seat S1 at least at the forming substation ST1.

When the containing element 20 is moved from the first receiving position P1 to the second release position P2, the first piston 13 is positioned at a height such as to crate continuity with the lower wall 51 of the housing element 21 so as to define the bottom F of the first seat S1.

The forming ST1 and release ST3 substations of the dose 33 are positioned along the periphery of the first rotary element 9, in such a way as to be engaged cyclically by the first seats S1 during rotation around the first axis X1.

More specifically, the forming ST1 and release ST3 substations of the dose are arranged in a predetermined position relative to a frame 29 of the filling station SR, along the closed movement path P1 of the first seats S1.

In a complete rotation of the first rotary element 9 each first seat S1 is positioned in the forming substation ST1 of the dose and in the release substation ST3 of the dose.

Advantageously, the filling unit 1 further comprises a substation ST2 for compacting the dose, configured to compact the dose inside the first seat S1. In alternative embodiments not illustrated, the station ST2 for compacting the dose can be omitted.

The compacting substation ST2 is located along the closed path PS between the substation ST1 for forming the dose and the substation ST3 for releasing the dose.

More specifically, the first seat S1 during rotation intercepts firstly (that is, it is positioned at) the forming station ST1, then the compacting station ST2 and lastly the substation ST3 for releasing the dose.

Preferably, the closed path PS is a circular path around the first axis X1.

Still more preferably, the closed path PS lies on a horizontal plane.

Described below is the substation ST1 for forming the dose 33.

The substation ST1 for forming the dose 33 is positioned in a region R1 for forming the dose 33.

At the substation ST1 for forming the dose 33 there is the release device 6, designed for releasing a predetermined quantity of product (defining the dose 33) inside the containing seat S1 positioned in the region R1 for forming the dose 33.

The releasing device 6 according to a first embodiment comprises a hopper 38 (filled, in use, with loose product) having at the bottom an outfeed for the product.

It should be noted that the hopper 38 is configured to create a layer of product at the region R1 for forming the dose 33 above the first seats S1, so as to release the product inside the first seat(s) S1 positioned, each time, in the forming region R1.

More specifically, the outfeed of the hopper 38 is shaped in such a way as to occupy a portion of the closed movement path P1 of the first seats S1.

More specifically, according to one embodiment, the outfeed of the hopper is in the form of an arc, centred on the first axis X1.

The outfeed of the hopper 38 releases the product to a plurality of first seats S1 positioned temporarily in the region R1, that is to say, opposite below the outfeed of the hopper 38.

In other words, the first seats S1, passing below the hopper 38, are filled with product, in a filling time which depends on the speed of transit of the first seats S1 in the forming region R1 and on the amplitude of the portion of the closed movement path PS of the first seats S1 occupied by the outfeed 19 of the hopper 38.

According to one embodiment, the release device 6 comprises at least a first rotary element 40*a*, designed to rotate about a first longitudinal axis of rotation X4.

The first axis of rotation X4 of the first rotary element 40*a* is fixed relative to the hopper 38, or equally, to the frame 29.

The first rotary element 40*a* is configured to create a flow of product (under pressure) which intercepts the at least one first seat S1 and to release the product inside the at least one first containing seat S1 in transit through the region R1 for forming the dose.

Preferably, the first rotary element 40*a* is operating in the region R1 for forming the dose on a seat S1, or on a plurality of seats S1 simultaneously in transit through the forming region R1.

It should be noted that the release device 6 also comprises drive means (such as, for example, a first drive unit), operatively coupled to the first rotary element 40*a* to rotate the rotary element 40*a*.

Described below is an embodiment in which the first rotary element 40*a* comprises an element 41*a* defining a surface with a helical extension.

The helical surface extends—in a spiral shape—along the first axis of rotation X4 of the first rotary element 40*a*.

Figure 21:
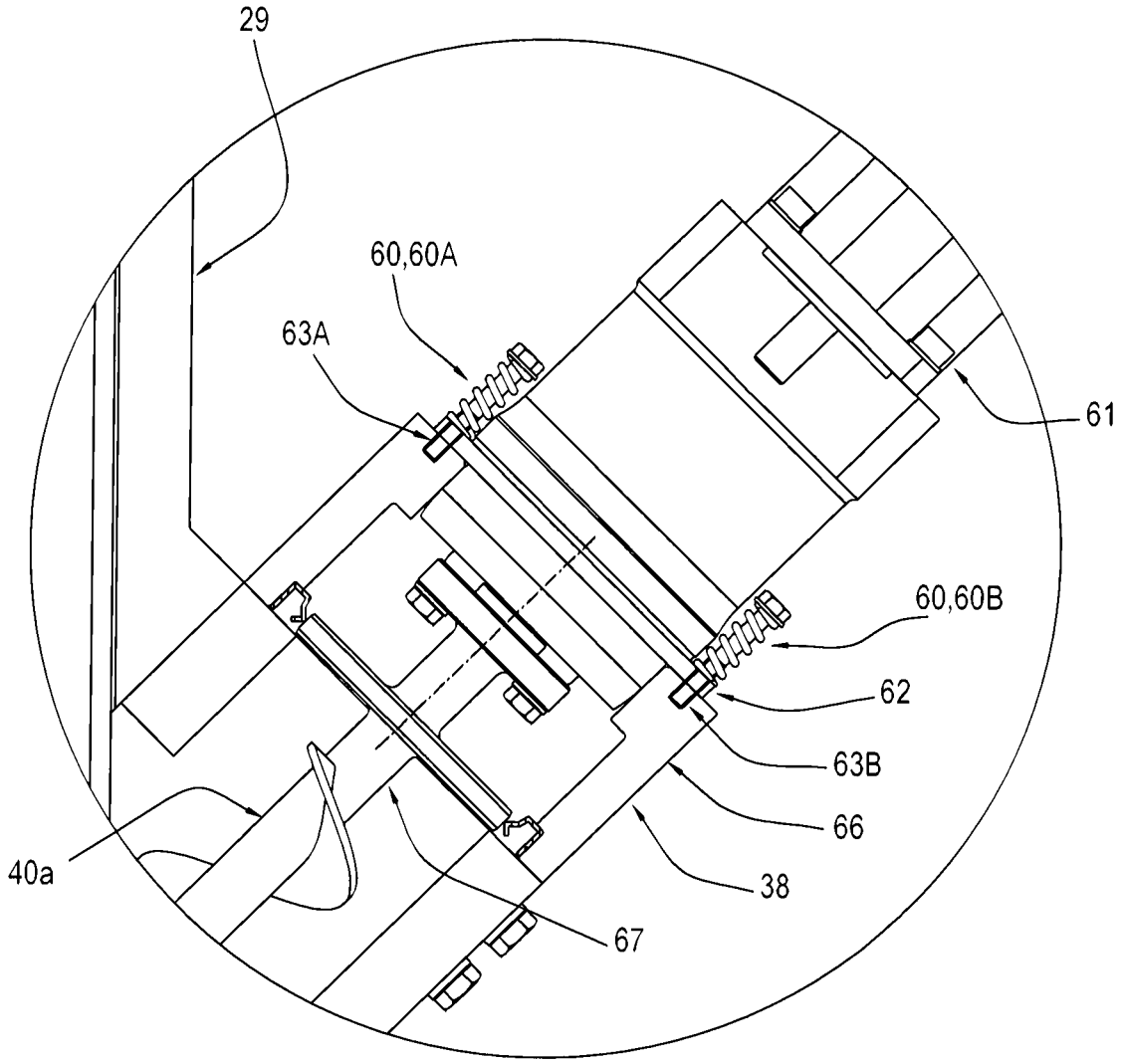
FIG. 21 shows a further embodiment of the filling device, applicable to the filling unit illustrated in FIGS. 1 to 12.

This embodiment is illustrated in FIGS. 1 to 12 and in FIG. 21.

Rotary element 40*a*, 40*b* has a helical profile which extends between a first end E1 and a second end E2.

The rotary element 40*a*, 40*b* is configured to rotate, at a speed of rotation, about a respective longitudinal axis of rotation X4, X5 stationary with respect to the hopper 38, in such a way that the first end E1 adopts an angular position variable over time about the respective longitudinal axis of rotation X4, X5, for creating an axial feed flow of product, from the second end E2 towards the first end E1, which intercepts the at least one first containing seat S1 so as to release the product inside the at least one first containing seat S1.

This respective axis of rotation X4, X5 is stationary with respect to the hopper 38.

It should be noted that the axis of rotation X4, X5 of the rotary element 40*a* is inclined relative to a horizontal plane.

According to this aspect, the product is fed from the rotary element 40*a*, 40*b* angularly, according to the direction of extension of the axis of rotation X4, X5, so that the motion of the product has, as well as a horizontal component, also a vertical component which favours the insertion of the product inside the first seat S1 in transit in the region R1 for forming the dose (slightly compressing the product inside the first seat S1).

Advantageously, therefore, the fact that the axis X4, X5 of the rotary element 40*a*, 40*b* is angularly positioned with respect to a horizontal plane makes it possible to optimize the filling of the first seat S1.

The rotary element 40*a*, 40*b* is rotated in such a way that the product is pushed, along the direction of extension of the axis of rotation X4, in the direction from the second end E2 towards the first end E1.

It should be noted that the rotary element 40*a*, 40*b* defines a unit for feeding the product inside the first seat S1.

It should also be noted that the release device 6 comprises drive means (such as, for example, a drive unit), operatively coupled to the relative element 40*a*, 40*b* for rotating the rotary element 40*a*, 40*b*. The first rotary element 40*a* also comprises a respective first shaft 42*a*, to which the element 41*a* is connected, defining a surface with a helical extension for being rotated.

The first shaft 42*a* is supported rotatably relative to the frame 29 of the filling unit 1.

The first shaft 42*a* extends along the first axis of rotation X4 of the first rotary element 40*a*.

It should be noted that the first rotary element 40*a* described above defines a screw feeder, which by rotation about the first axis of rotation X4 allows a feeding of the product along the direction of axial extension of the first axis of rotation X4.

With reference to the axis of rotation X4 of the first rotary element 40*a*, the following should be noted.

In a further embodiment, not illustrated, the axis of rotation X4 of the first rotary element 40*a* is horizontal.

It should be noted that according to a second embodiment, not illustrated, the axis of rotation X4 of the first rotary element 40*a* is vertical.

Preferably, more generally speaking, the unit 1 comprises a first rotary element 40*a* and a second rotary element 40*b*, both acting in conjunction for filling the first seat S1 in the region R1.

Figure 12:
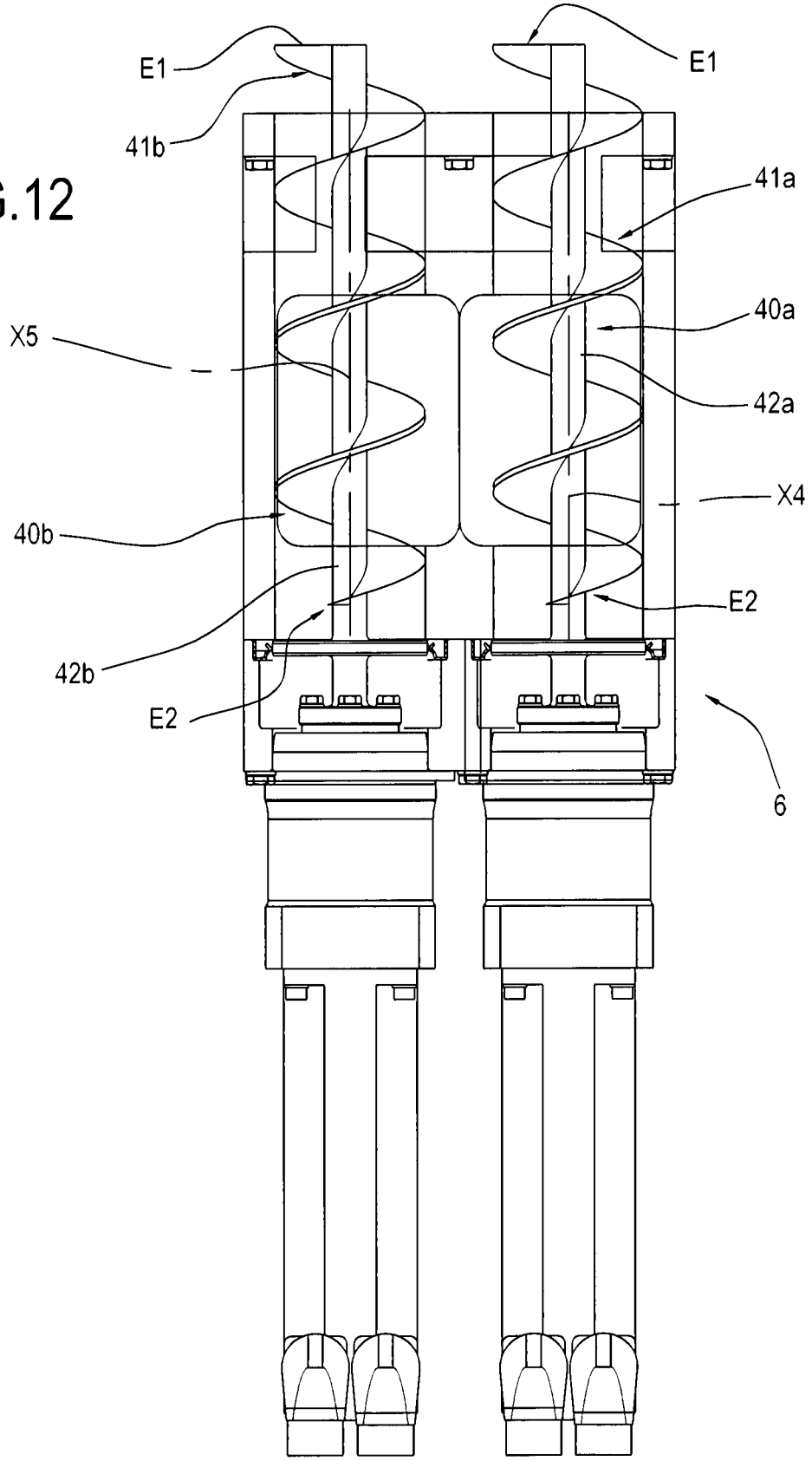

Therefore, preferably, the release device 6 comprises, in addition to the first rotary element 40*a*, a second rotary element 40*b*, designed to rotate about a second longitudinal axis of rotation X5 (FIG. 12).

It should be noted that the release device 6 also comprises drive means, operatively coupled to the first rotary element 40*a* and to the second rotary element 40*b* to rotate the first rotary element 40*a* and the second rotary element 40*b*.

The second axis of rotation X5 of the second rotary element 40*b* is parallel to the first axis X4.

With regard to the second rotary element 40*b*, all the considerations and the technical and functional features which have been and will be described with reference to the first rotary element 40*a* apply.

It should be noted that, according to the embodiments of FIGS. 1 to 12 and 21, each of the two rotary elements 40*a*, 40*b* is equipped with a respective helical element 41*a*, 41*b* and a respective shaft 42*a*, 42*b*, to which a respective helical is connected for being rotated.

The second shaft 42*b* is supported rotatably relative to the frame 29 of the filling unit 1.

The second shaft 42*b* extends along the second axis of rotation X5 of the second rotary element 40*b*.

The second rotary element 40*b* also defines a screw feeder, which by rotation about the second axis of rotation X5 allows a feeding of the product along the direction of axial extension of the second axis of rotation X5.

Advantageously, the first rotary element 40*a* and the second rotary element 40*b* rotate accordantly, or discordantly.

It should be noted that the shafts 42*a*, 42*b* of the first and the second rotary element 40*a*, 40*b* are parallel to each other.

It should also be noted that, according to another aspect, the hopper 38 is equipped with a lower portion 19 for releasing the product (defined by the outlet 19 and denoted in the drawings with the same numerical reference) to the first seat S1 and the first end E1 of the helical profile of the above-mentioned at least one rotary element 40*a*, 40*b* is positioned facing above, and close to, the lower portion 19 for releasing the product of the hopper 38.

In this way, advantageously, the rotary element 40*a*, 40*b* with a helicoidal profile is positioned proximal to the first seat S1 to be filled so as to apply a compressive action on the product released inside the first seat.

Preferably, the first seat S1 has a circular shape in plan having a predetermined diameter and the hopper 38 has a lower portion 19 for releasing the product (defined by the outlet 19) to the first seat S1 having a width in plan substantially equal to the predetermined diameter of the first seat S1.

According to this aspect, advantageously, the release of the product to the first seat S1 is optimised, that is, the identical dimensions in plan of the first seat S1 and lower portion 19 for releasing the product substantially avoids any accumulation of product at the bottom of the hopper 38.

According to an embodiment of the invention (FIGS. 13 to 15), the unit 1 is also equipped with a drive and control unit 15, operatively connected to the at least one rotary element 40*a*, 40*b* and configured to rotate it at a speed of rotation variable as a function of the angular position of the first end E1 of the rotary element 40*a*, 40*b* (about the respective axis of rotation X4, X5).

It should be noted that the drive and control unit 15 comprises a or more electronic control cards.

In other words, the drive and control unit 15 is configured to actuate and change the speed of rotation of the rotary element 40*a*, 40*b* as a function of the angular position of the first end E1 of the rotary element 40*a*, 40*b*.

For this reason, the drive and control unit 15 rotates the rotary element 40*a*, 40*b* according to a (variable) speed profile (that is, law) which depends on the angular position of the first end E1 of the rotary element 40*a*, 40*b*.

Surprisingly, it have been observed that the drive at a variable speed of the rotary element as a function of the angular position of the first end E1 of the rotary element 40*a*, 40*b* allows the variability of the weight of the product introduced in the first seats S1 to be reduced (which translates into a reduction in the variability of the weight of the product introduced in the rigid, cup-shaped containers), that is, it renders uniform the quantity of product introduced in the first seats S1.

According to the invention, the effect of the thrust by the first end E1 of the rotary element 40*a* variable as a function of the angular position of the first end E1 of the rotary element 40*a*, 40*b* is compensated by a command of the rotary element 40*a*, 40*b* according to a speed profile variable as a function of the angular position of the first end E1 of the rotary element 40*a*, so that the thrust is as uniform as possible over time and independent of the angular position of the first end E1 of the rotary element 40*a*, 40*b*.

In practice, therefore, according to the invention, the fact of rotating the rotary element 40*a*, 40*b* at a variable speed which depends on the angular position of the first end E1 (the one proximal to the first seat S1) makes it possible to render uniform the thrust of the product towards the first seats S1 and, therefore, the filling between the different seats S1.

It should also be noted that, according to the invention, a complete rotation of the rotary element 40*a*, 40*b* fills a plurality of first seats S1 with product; therefore, the first seats S1 filled in a complete rotation of the rotary element are filled with the first end E1 located in different positions.

Is therefore evident that the invention allows the filling of the various seats S1 to be made uniform, since the pushing effect in different angular positions of the first end E1 of the helical profile of the rotary element 40*a*, 40*b* is made uniform.

Some aspects relating to the control of the speed of the rotary element 40*a*, 40*b* are described below.

Figure 13:
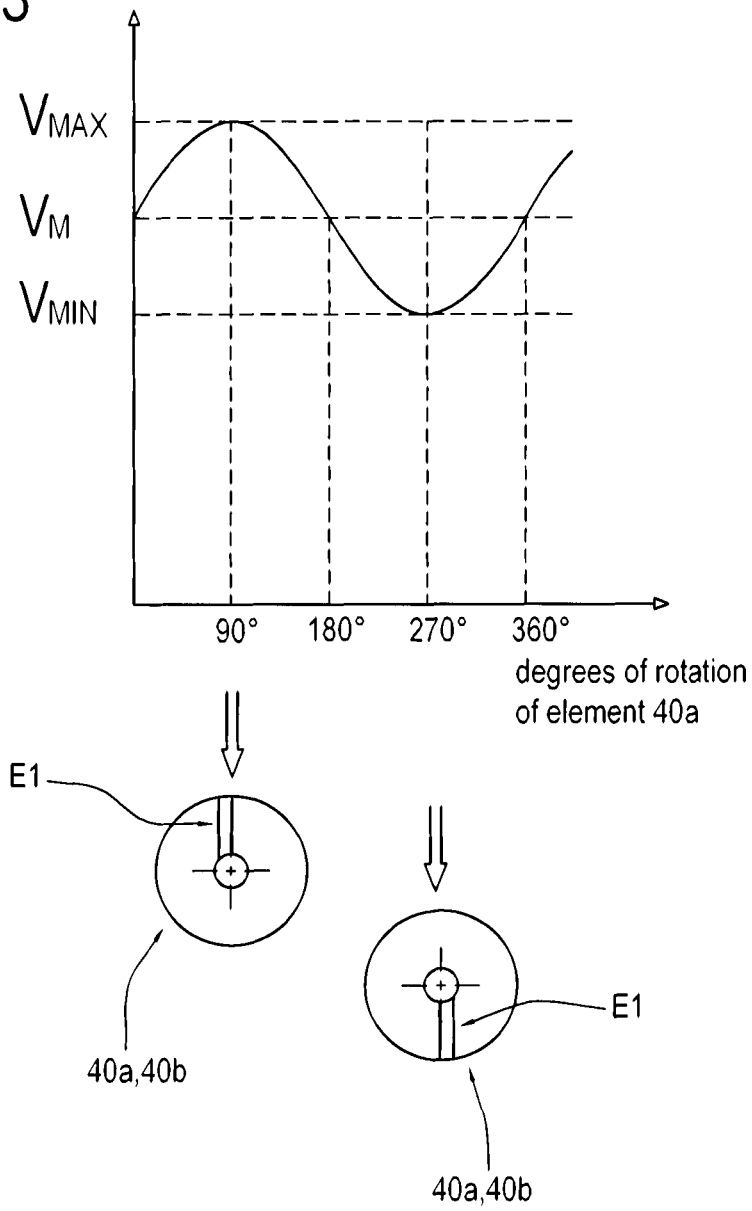
FIG. 13 schematically illustrates a preferred law of speed of rotation of a rotary element forming part of the filling unit according to FIGS. 1 to 12.

Preferably, as illustrated in FIG. 13, the drive and control unit 15 is configured to rotate the at least one rotary element (40*a*, 40*b*) according to a sinusoidal law of speed L1, L2, having a predetermined average value VM or average speed as a function of the angular position of the first end E1 of the rotary element 40*a*, 40*b*.

FIG. 13 shows a representation of the speed profile of the first end E1 of the rotary element 40*a*, 40*b* as a function of the angular position (in sexagesimal degrees) of the first end E1 (shown beneath the graph of FIG. 13 for two angular positions, respectively for 90° and 270°).

More specifically, again with reference to the aspect illustrated in FIG. 13, the drive and control unit 15 is configured to rotate the at least one rotary element 40*a*, 40*b* according to a sinusoidal law of speed L1, L2, having a predetermined amplitude (difference between VMAX and VM).

Still more preferably, the drive and control unit 15 is configured to rotate the at least one rotary element 40*a*, 40*b* according to a sinusoidal law of speed L1, L2, having a predetermined amplitude (difference between VMAX and VM) and a predetermined average value VM.

It should be noted that, preferably, the drive and control unit 15 is configured to rotate the at least one rotary element 40*a*, 40*b* in such a way that the sinusoidal function has a maximum value (VMAX) when the first end E1 is positioned at the top (90° position in FIG. 13) and a minimum value (VMIN) when the first end E1 is located at the bottom (270° position in FIG. 13).

Alternatively, the drive and control unit 15 is configured to rotate the at least one rotary element 40*a*, 40*b* according to a saw tooth law of speed L1, L2, having a predetermined average value VM as a function of the angular position of the first end E1 of the rotary element (40*a*, 40*b*).

More generally speaking, the drive and control unit 15 is configured to rotate the at least one rotary element 40*a*, 40*b* as a function of the angular position of the first end E1 of the rotary element 40*a*, 40*b* according to a law of speed L1, L2 having a predetermined average value VM and which comprises in a complete rotation a minimum speed value (VMIN) and a maximum speed value (VMAX).

In the embodiment illustrated, the maximum speed value (VMAX) corresponds to an upper position of the first end E1 of the rotary element 40*a*, 40*b*, whilst the minimum speed value o (VMIN) corresponds to a lower position of the first end E1 of the rotary element 40*a*, 40*b*.

In alternative embodiments not illustrated, the drive and control unit 15 is configured to rotate the at least one rotary element 40*a*, 40*b* as a function of the angular position of the first end E1 of the rotary element 40*a*, 40*b* according to a law of speed L1, L2 having more than one minimum speed value and/or more than one maximum speed value.

In general, the drive and control unit 15 is configured to rotate the at least one rotary element 40*a*, 40*b* as a function of the angular position of the first end E1 of the rotary element 40*a*, 40*b* according to a law of speed L1, L2 having periodic characteristics.

Advantageously, the release device 6 comprises a pair of rotary elements 40*a*, 40*b*, that is to say:

- a first rotary element 40*a* having a helical profile which extends between a first end E1 and a second end E2, designed to rotate about a respective first axis of rotation X4, stationary with respect to the hopper 38 and angularly inclined to a horizontal plane to create an axial feeding flow of product, from the second end E2 towards the first end E1 which intercepts (in the region R1 for forming the dose) the at least one first containing seat S1 so as to release the product inside the at least one first containing seat S1;
- and a second rotary element 40*b* having a helical profile which extends between a first end E1 and a second end E2 and designed to rotate about a respective second axis of rotation X5, stationary with respect to the hopper 38 and angularly inclined to a horizontal plane, to create an axial feeding flow of product, from the second end E2 towards the first end E1 which intercepts the at least one first containing seat S1 so as to release the product inside the at least one first containing seat S1.

It should be noted that preferably the second rotary element 40*b* is positioned parallel to the first rotary element 40*a* (that is, the axes X4 and X5 are parallel with each other).

The axis of rotation X5 of the second rotary element 40*b* is stationary relative to the hopper 38, or, equally, to the frame 29.

The axis X5 is also angularly positioned relative to a horizontal plane.

It should also be noted that the second rotary element 40*b* described above, by rotation about the further axis of rotation X5, allows a feeding of the product along the direction of axial extension defined by the further axis of rotation X5 (so as to fill the seats S1 in transit in the forming region R1).

In the embodiment illustrated in the drawings, the drive and control unit 15 is operatively connected to the first rotary element 40*a* and the second rotary element 40*b* and is configured to rotate the first rotary element 40*a* and the second rotary element 40*b* according to a first and a second speed of rotation, respectively, variable as a function of the angular position of the first end E1 of the respective helical profile.

The drive and control unit 15 is configured to rotate the first rotary element 40*a* and the second rotary element 40*b* according to respective laws of speed L1, L2.

Figure 14:
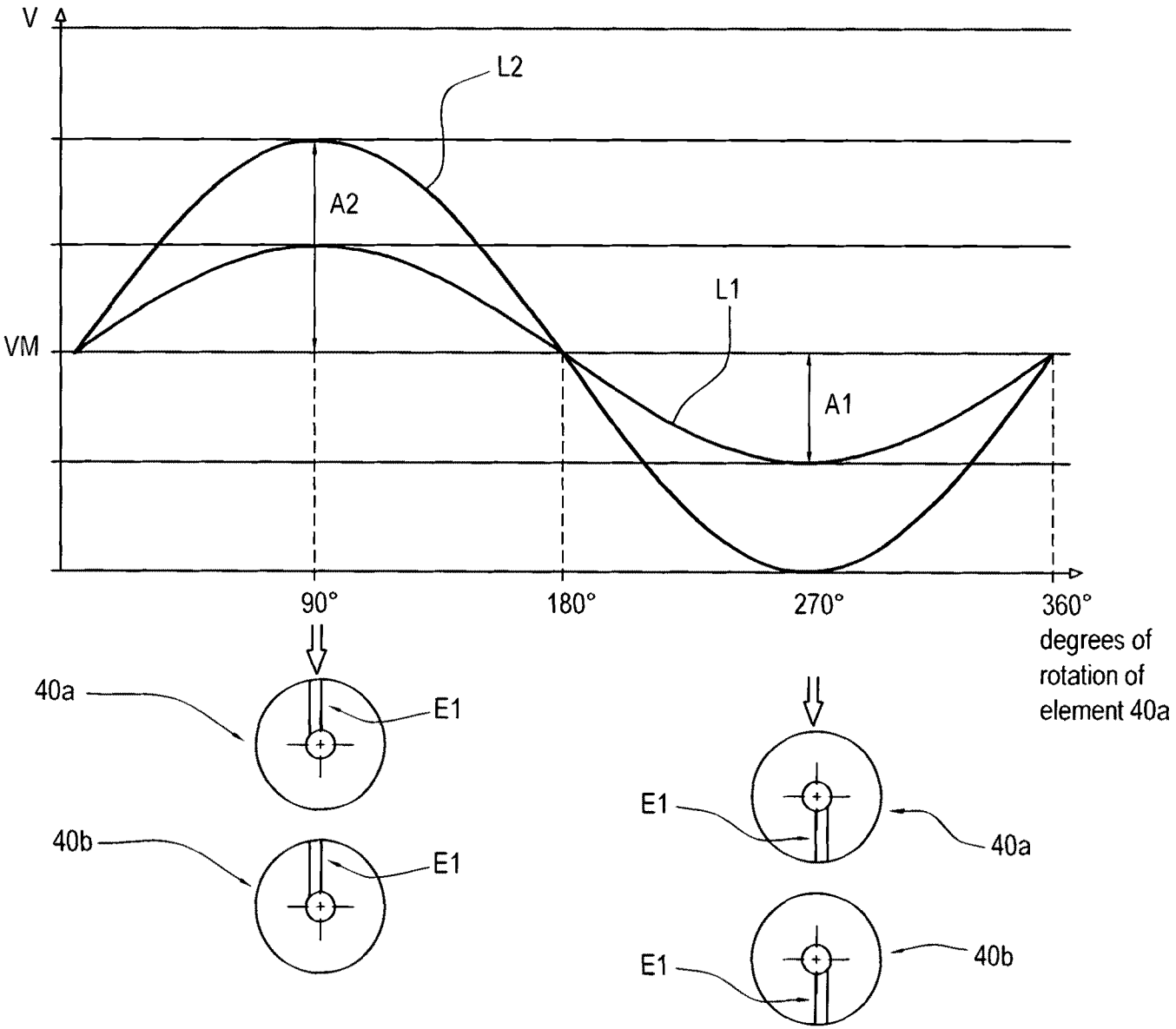
FIG. 14 schematically illustrates a first law of speed of rotation of two rotary elements forming part of the filling unit according to FIGS. 1 to 12.
Figure 15:
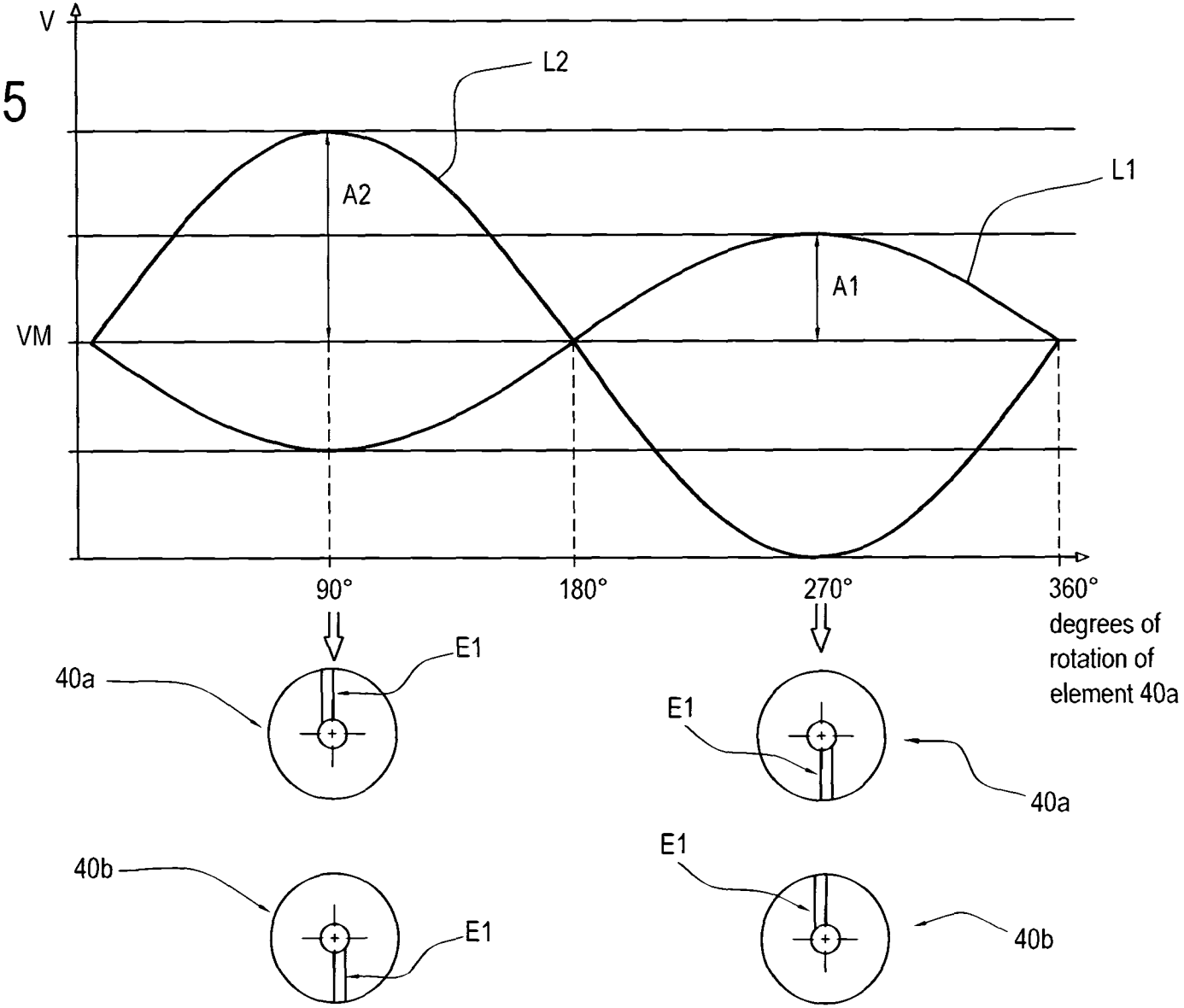
FIG. 15 schematically illustrates a second law of speed of rotation of two rotary elements forming part of the filling unit according to FIGS. 1 to 12.

Preferably, the drive and control unit 15 is configured to operate the first rotary element 40*a* and the second rotary element 40*b* according to speeds which vary in a sinusoidal fashion (as illustrated in FIGS. 14 and 15.

The drive and control unit 15 is configured to operate the first rotary element 40*a* and the second rotary element 40*b* at the same frequency of rotation (that is to say, at the same average speed VM). In other words, the first rotary element 40*a* performs a complete rotation of 360° in the same time in which the second rotary element 40*b* performs a complete rotation of 360°.

Still more preferably, the drive and control unit 15 is configured to rotate the first rotary element 40*a* and the second rotary element 40*b* according to a predetermined phase relationship (angular), for example as illustrated in FIGS. 14 and 15.

With reference in particular to FIG. 15, it should be noted that, preferably, the drive and control unit 15 is configured to rotate the first rotary element 40*a* and the second rotary element 40*b* in phase opposition (in such a way that at a given instant a maximum value of the speed of rotation of the first rotary element 40*a* corresponds to a minimum value of the speed of rotation of the second rotary element 40*b*).

Generally speaking, the drive and control unit 15 is configured to rotate the first rotary element 40*a* and the second rotary element 40*b* in phase, in such a way that, having defined a time interval (period), the first ends E1 of the respective rotary elements 40*a*, 40*b* adopt a same mutual angular position.

In alternative embodiments not illustrated, the drive and control unit 15 is configured to rotate the fist rotary element 40*a* and the second rotary element 40*b* in phase, in such a way that a complete rotation of the first unit rotary element 40*a* corresponds to one or more complete, or partial, rotations of the second rotary element 40*b*, or that a complete rotation of the second rotary element 40*b* corresponds to one or more complete, or partial, rotations of the first rotary element 40*a*. In other words, a complete rotation of the first rotary element 40*a* may correspond a multiple number, not necessarily a whole number, of rotations of the second rotary element 40*b*.

It should be noted that the degrees of rotation indicated on the X-axis of FIGS. 14 and 15 correspond to the angular position of the first end E1 of the first rotary element 40*a* which varies over time t.

According to what has been described above and with reference to the embodiment illustrated in the accompanying drawings, the hopper 38 is preferably equipped with a lower portion 19 for releasing the product to the first seat S1 and the first ends E1 of the helical profile of the first and of the second rotary element 40*a*, 40*b* are positioned facing above, and close to, the above-mentioned lower portion of the hopper 38 for releasing the product.

According the aspect described above, the first rotary element 40*a* and the second rotary element 40*b* are positioned relative to one another in such a way that the first rotary element 40*a* intercepts firstly the first seat S1 arriving in the forming region R1.

Again, advantageously, according to this aspect, the drive and control unit 15 is configured to rotate the second rotary element 40*b* with a second amplitude A2 which is different to, advantageously greater than, a first amplitude A1 of the first rotary element 40*a* (as illustrated in FIGS. 14 and 15).

The technical effect associated with the above-mentioned features is described below.

It should be noted that the first seat S1, at the second rotary element 40*b*, is already partly filled (by the effect of the product introduced from the hopper and by the first rotary element).

According to this aspect, under equal conditions of average speed of rotation (that is, frequency of rotation), due to the effect of the greater amplitude (A1) of the speed of rotation of the second rotary element 40*b*, the second rotary element 40*b* applies a thrust on the product to be inserted in the first seat S1 which is greater than that of the first rotary element 40*a*.

In this way, after the first rotary element 40*a* has loaded product in the first seat S1, the second rotary element 40*b* applies a compression of the product inside the first seat S1, a compression which is necessary for loading inside the first seat S1 a predetermined quantity of product.

As illustrated in FIGS. 14 and 15, the drive and control unit 15 is also configured for rotating the second rotary element 40*b* with an average speed VM equal to the average speed VM of the first rotary element 40*a*.

According to another aspect, in contrast to what is illustrated in FIGS. 14 and 15, the drive and control unit 15 is on the contrary configured to rotate the second rotary element 40*b* with a average speed (frequency of rotation) which is higher than the average speed of the first rotary element 40*a*.

Advantageously, in the embodiment with a first rotary element 40*a* and a second rotary element 40*b*, the drive and control unit 15 of the machine 100 rotates the rotary elements 40*a*, 40*b* and moves the first seat S1 at a speed such that, if a first seat S1 passes the first rotary element 40*a* driven at a maximum speed of rotation, the first seat S1 passes the second rotary element 40*b* driven at a minimum speed of rotation.

According to yet another aspect, it should be noted that the control unit 15 of the unit 1 (which advantageously also controls the machine 100) is designed to rotate the at least one first rotary element 40*a* of the release device 6 (and preferably also the second rotary element 40*b*) with an average speed depending on the speed of movement of the first seat S1 by the first rotary element 9.

The rotary element 40*a*, 40*b* is associated with (positioned inside) the hopper 38, which also forms part of the release device 6.

It should be noted that the hopper 38 is defined by corresponding side walls, which are vertical and/or inclined.

More specifically, in the embodiments shown in the accompanying drawings, the filling unit 1 comprises a hopper 38 to which the first rotary element 40*a* and the second rotary element 40*b* are associated (positioned inside).

It should be noted that, advantageously, the presence of one or more rotary elements 40*a*, 40*b* prevents the product, in particular with powder type products (such as, for example, coffee), from creating blockages, that is, build-ups, inside the hopper which render incomplete the filling of the first seats S1 in transit through the region R1 for forming the dose. Indeed, it should be noted that the one or more rotary elements 40*a*, 40*b* are rotated so as to move the product and prevent the formation of any blockage inside the hopper 38 for feeding the product. In this way, advantageously, the speed at which the unit 1 may be used is particularly high and, consequently, the unit 1 is particularly fast and reliable in its operation.

Further, with two units 40*a*, 40*b* forming part it is possible to even out further the quantity of product inside the rigid containers 2, in other words by reduce the variability in weight of the doses 33 fed.

With reference to the movement of the piston 13 in the region R1 for forming the dose, the following should be noted.

Preferably, when the above-mentioned first seat S1 is inside the region R1 for forming the dose, in particular at the infeed zone, the first piston 13 associated with the first seat S1 is positioned in a predetermined position (vertical) wherein it defines a predetermined space in the first seat S1.

According to a possible operating mode, the first piston 13 can be moved (vertically) from the top downwards in such a way that the first seat S1 is filled, not only by gravity acting on the product which causes the product to enter the seat S1, but also due to the suction effect on the product caused by the movement (displacement) of the piston 13 from an upper position to the desired (lower) position.

In this way, advantageously, thanks to the additional suction effect due to the lowering of the first piston 13, the resulting speed of the machine 100 at the filling station SR, in particular at the substation ST1 for forming the dose, is particularly high.

According to this invention, by varying the position (vertical) of the piston 13 by means of the movement means 14 in the region R1 for forming the dose 33 it is possible to vary the quantity of product contained in the first seats S1, or in other words, it is possible to vary the dose 33. Basically, the movement means 14 are designed to position the piston 13 in a desired dosing position at an outfeed zone of the region R1 for forming the dose 33, wherein a levelling element of the hopper 38 defines the dose 33.

With reference to the compacting substation ST2, it should be noted that the compacting substation ST2 is equipped with compacting means 101 designed to compress the product, in phase with the piston 13, inside the first seat S1.

The compacting means 101 are described below in more detail.

In the example described, the compacting means 101 comprise a compacting element 26.

The compacting element 26, in the preferred embodiment illustrated, comprises a compacting piston.

It should be noted that the compacting element 26 is connected to the (carried by the) rotary element 9 of the filling station SR.

In practice, the compacting element 26 is rotated by the rotary element 9, as one with the first seat S1.

More specifically, the filling unit 1 preferably comprises a compacting element 26 associated with every containing seat S1.

The compacting element 26 is movable vertically, between a raised non-operating position and a lowered operating position.

It should be noted that the compacting element 26 is positioned in the lowered operating position at the substation ST2 for compacting the dose.

The compacting element 26 is positioned above the first piston 13.

In practice, the compacting element 26 is positioned relative to the rotary element 9 in a position such that in the lowered operating position it can be inserted through the first upper opening 23A of the upper wall 50 of the housing element 21.

On the other hand, the first piston 13 is positioned relative to the rotary element 9 in a position such that the first piston 13 can pass through the first lower opening 22A of the lower wall 51 of the housing element 21.

It should be noted that the lower face of the compacting element 26 defines, at the compacting region R2, an upper contact element of the dose 33 positioned inside the first seat S1, so as to compact the product.

In other words, the dose S1 is compressed between the first piston 13 and the compacting element 26, by the action of the compression applied by the latter.

Alternatively, once the dose 33 is formed, the first piston 13 can be moved to compact the product and the compacting element 26 act as a fixed contact element for the first piston 13. In other words, the drive and control unit 15 can move one or other, or both, between the first piston 13 and the compacting element 26 for compressing the dose 33.

It should also be noted that, according to an embodiment not illustrated, the filling unit 1 comprises a single compacting element 26 which is stationary relative to the frame 29 (that is, it is not rotated by the rotary element 9). Advantageously, the compacting element 26 may comprise a fixed plate, or a plate rotating about a vertical axis.

Alternatively, according to an embodiment not illustrated, the compacting element 26 may be omitted and replaced by an upper fixed contact element, for example a plate stationary relative to the frame 29.

According to another aspect, advantageously, the filling unit 1 further comprises at least one ejection device 36 movable at the substation ST3 for releasing the dose to abut (at the top) the dose 33 inside the at least one first containing seat S1 and eject it to the outside of the first seat S1 so as to release it inside the containing element 2 (located under the first seat S1 waiting).

Advantageously, the ejection device 36 is movable vertically.

More specifically, according to the embodiment illustrated in the accompanying drawings, the filling unit 1 comprises a plurality of ejection devices 36, with each of the ejection devices 36 being associated with a first seat S1.

Preferably, the ejection devices 36 comprise a piston, configured to abut the top of the dose 33 inside the first seat S1 at the substation ST3 for releasing the dose.

It should be noted that at the substation ST3 for releasing the dose, the closed path PS of the first seat S1 is positioned above the first movement path P of the transport line 4 (and hence of the containers 2).

These ejection devices 36 are movable between an upper non-operating position and a lower operating position, wherein they make contact (at the top) with the dose 33 inside the seat S1 to cause the ejection.

It should be noted that the ejection device 36 is positioned in the lowered operating position at the substation ST3 for releasing the dose 33, as described in more detail below.

The ejection device 36 is located above a piston 23 for lifting the container 2.

It should be noted that the unit 1 also comprises a piston 23 for lifting the container 2, which is movable at the substation ST3 for releasing the dose between a lower position and an upper position for lifting the container 2.

Advantageously, the lifting piston 23 is movable vertically.

Preferably, the filling unit 1 comprises a lifting piston 23 for each first containing seat S1; preferably, each piston 23 rotated by the rotary element 9 as one with the first seat S1. The lifting piston 23 may be driven by respective actuators, or by a fixed cam.

In practice, the ejection device 36 is positioned relative to the housing element 21 in a position such that in the lowered operating position the ejection device 36 can be inserted through the second upper opening 23B of the upper wall 50.

On the other hand, the lifting piston 23 is positioned relative to the housing element 21 in a position aligned relative to the second lower opening 22B.

It should be noted that the lower face of the ejection device 36 abuts at the top, at the region R3 for releasing the dose, the dose 33 positioned inside the first seat S1, in such a way as to push the product towards the outside of the seat S1 to release the dose inside the container 2 lifted by the lifting piston 23.

It should be noted that at the region R3 for releasing the dose 33 the container 2 is raised, for moving the container 2 to the second lower opening 22B and minimising the escape of product.

It should also be noted that, according to an embodiment not illustrated, advantageously in the case of step operation, the filling unit 1 comprises a single ejection device 36 which is stationary relative to the frame 29 of the unit 1.

The ejection device(s) 36 is/are movable, and operate on the first seat S1 at the release substation ST3.

According to an alternative embodiment not illustrated, the ejection device 36 may be omitted and the dose 33 may fall by gravity inside the container 2 when the seat S1 is located at the release position P2, that is, when the seat S1 is aligned with, that is, in fluid communication with, the second lower opening 22 B.

With reference to the compacting element(s) 26, the ejection devices 36, the first piston 13 and the piston lifting 23, it should be noted that the above-mentioned elements/devices 26, 36 and pistons 13, 23 are supported (vertically movable) by the rotary element 9, that is to say, they are positioned in a predetermined radial position.

The compacting element(s) 26, ejection device(s) 36, first piston(s) 13 and the lifting piston(s) 23 are movable vertically, as described above.

With reference to the filling unit 1 in its entirety, it should be noted that the unit 1 also comprises a unit 15 (formed by one or more electronic cards) for drive and control of the drive means of the first rotary element 9.

Advantageously, the drive and control unit 15 is also configured to control the advance of the transport element 39 and the movable elements of the filling station SR (for example, the pistons 13 and 23, the compacting elements 26 and the ejecting devices 36).

It should be noted that the drive and control unit 15 coordinates and controls the step of moving all the above-mentioned elements connected to it, so as to allow the operations described below to be performed.

The filling unit 1 according to the invention may advantageously form part of a packaging machine 100 (illustrated in FIG. 1) designed for packaging single-use capsules for extraction or infusion beverages, for example of the type described above. The packaging machine 100 further comprises a plurality of stations, positioned along the first path P performed by the transport element 39, configured to operate in a synchronised fashion (preferably continuously) with the transport element 39 and with the filling station SR, including at least:

- a station SA for feeding rigid containers 2 into corresponding seats 5 of the transport element 39;
- a station SC for closing the rigid containers, in particular the upper opening 31 of the rigid container 2, with a lid 34;
- an outfeed station which picks up the capsules 3 from the respective seats 5 of the transport element 39.
- In addition to the stations listed above (SA, SR, SC, SU), the packaging machine 100 may comprise further stations, such as, for example, one or more weighing stations, one or more cleaning stations, one or more control stations and, depending on the type of capsule to be packaged, one or more stations for applying filtering elements.

The operation of the filling unit 1 is briefly described below, in particular the filling station SR, with the aim of clarifying the scope of the invention: in particular, the filling of a rigid, cup-shaped container 2 is described with reference to the embodiment illustrated in the accompanying drawings (in particular FIGS. 4 to 8).

During movement (rotation) of the first rotary element 9, a first seat S1 designed to be filled with a dose 33 of product is positioned in the region R1 for forming the dose 33, that is to say, in the proximity of the substation ST1 for forming the dose 33.

It should be noted that the feeding device 6 feeds product in the region R1 for forming the dose 33, filling the first seat S1 at the forming region R1.

The movement of the first rotary element 9 is, preferably, a continuous type movement. Alternatively, the movement of the first rotary element 9 is of a step type.

More specifically, the first seat S1 is filled at the outfeed of the region R1 for forming the dose 33.

Advantageously, once the seat S1 has been filled, the filling unit 1 can operate a step for compacting the dose 33.

More specifically, from the substation ST1 for forming the dose, a rotation of the rotary element 9 by a predetermined angle moves the first seat from the substation ST1 for forming the dose to the substation ST2 for compacting the dose.

It should be noted that the containing element 20 (that is, the first seat S1) is kept in the position P1 for receiving the dose both at the substation ST1 for forming the dose and at the substation ST2 for compacting the dose.

At the compacting substation ST2, the compacting element 26 is moved from the top downwards, through the first upper opening 23A of the upper wall 21 of the housing element 50, until abutting the top of the dose 33 inside the first seat S1, to compact the dose.

The dose S1 is in effect inside the first seat S1 and supported by the first piston 13: the combined action of supporting the first piston 13 and compressing the compacting element 26 allows the dose to be compressed to a predetermined value.

Alternatively, the ejecting device 36 may act as upper contact for the dose 33 which is compressed by the action of the first piston 13. In other words, the dose 33 is compacted by moving one or other, or both, between the first piston 13 and compacting element 26, towards each other.

In practice, the dose 33 is subjected to a desired compression which determines a reduction in volume, so as to be able to dose more product inside the container 2.

The compacting element 26, after the compression is performed, is raised so as to come out of the seat S1.

At this point, the first seat S1—following a further rotation of the rotary element 9—is moved by rotation to the release substation ST3.

Simultaneously with that rotation, or immediately before or after, the position of the first seat S1 is adjusted in such a way as to move the first seat S1 from the position P1 for receiving the dose to the position P2 for releasing the dose.

In other words, the element 20, that is, the first seat S1, is moved radially, in such a way that the first seat S1 is positioned in the position P2 for releasing the dose at the substation ST3 for releasing the dose.

In the release position P2, the first seat S1, the second upper opening 23B and the second lower opening 22B are superposed on each other (that is, they occupy a shared region in plan).

Advantageously, at the release region/substation (R3/ST3) the lifting piston 23 is moved from the lowered position to the raised position, in such a way as to lift a container 2 not yet filled with product (and which must be filled with the product).

In order to perform the transfer, for a period of time depending on the speed of rotation of the rotary element 9, the first seat S1, the seat 5 of the chain 40 which carries the container 2 to be filled, the lifting piston 23 and the ejection device 36 are positioned superposed (at different heights) at the region R3 for releasing the dose.

The release of the dose 33 of product from the first seat S1 to the containing element 2 is described below.

The lifting piston 23 abuts the bottom of the container 2 in such a way as to lift the container 2.

It should be noted that the lifting piston 23 is moved (from the bottom upwards, that is, vertically) until the container 2 comes into contact with, that is moves close to, a tubular element 53 which extends downwards from the second lower opening 22B.

More specifically, the container 2 is positioned in such a way that the tubular element 53 is partially located inside it.

Advantageously, there is a transit gap between the tubular element 53 and the container 2 in a raised position, designed to minimise the escape of product from the container 2, but at the same time allow air to pass through during the release of the dose 33.

In practice, the tubular element 53 forms an extension of the second lower opening 22B; in more detail, the element 53 constitutes a channel for releasing the product from the first seat S1 to the container 2.

Once the first containing seat S1 is in release position P2, the dose 33 falls, or is pushed, towards the container 2 positioned below the tubular element 53, that is, to the second lower opening 22B.

Advantageously, so as to favour the transfer of the product from the first seat S1 to the container 2, the ejection device 36 is moved from the non-operating raised position to the lowered operating position.

During the movement from the non-operating raised position to the lowered operating position, the ejection device 36 comes into contact with the dose 33 of product which is positioned inside the first seat S1, pushing it downwards and encouraging the escape from the first seat S1.

The dose 33 is transferred from the first seat S1 to the containing element 2.

It should be noted that at the step of transferring the dose 33 from the first seat S1 to the container 2, the seat S1 and the container 2 are moved along superposed trajectories, in such a way that the container 2 is positioned below the first seat S1 for a shared stretch.

It should be noted that, after the transfer, a flow of air is preferably released on the collar 32 (upper edge) of the container 2.

For that purpose, the filling unit 1 comprises means 55 for releasing fluid, that is, air or inert gases, such as for example, nitrogen, CO2, etc., operatively associated with the release station ST3 to release a flow of fluid on the collar 32 of the container 2.

It should be noted that the ejection device 36, when the flow of fluid is released on the container 2, is in the lowered operating position.

More specifically, when the flow of fluid is released on the containing element 2, the container 2 is preferably closed by the tubular element 53, thereby preventing escape of product.

It should be noted that the release of the flow of air (by the fluid release means 55) means that the containing collar 32 of the container 2 is cleaned, in such a way that it is in perfect order for the subsequent operations, in particular for the operation of sealing a piece 34 of sealing sheet to the collar 32.

Figure 9:
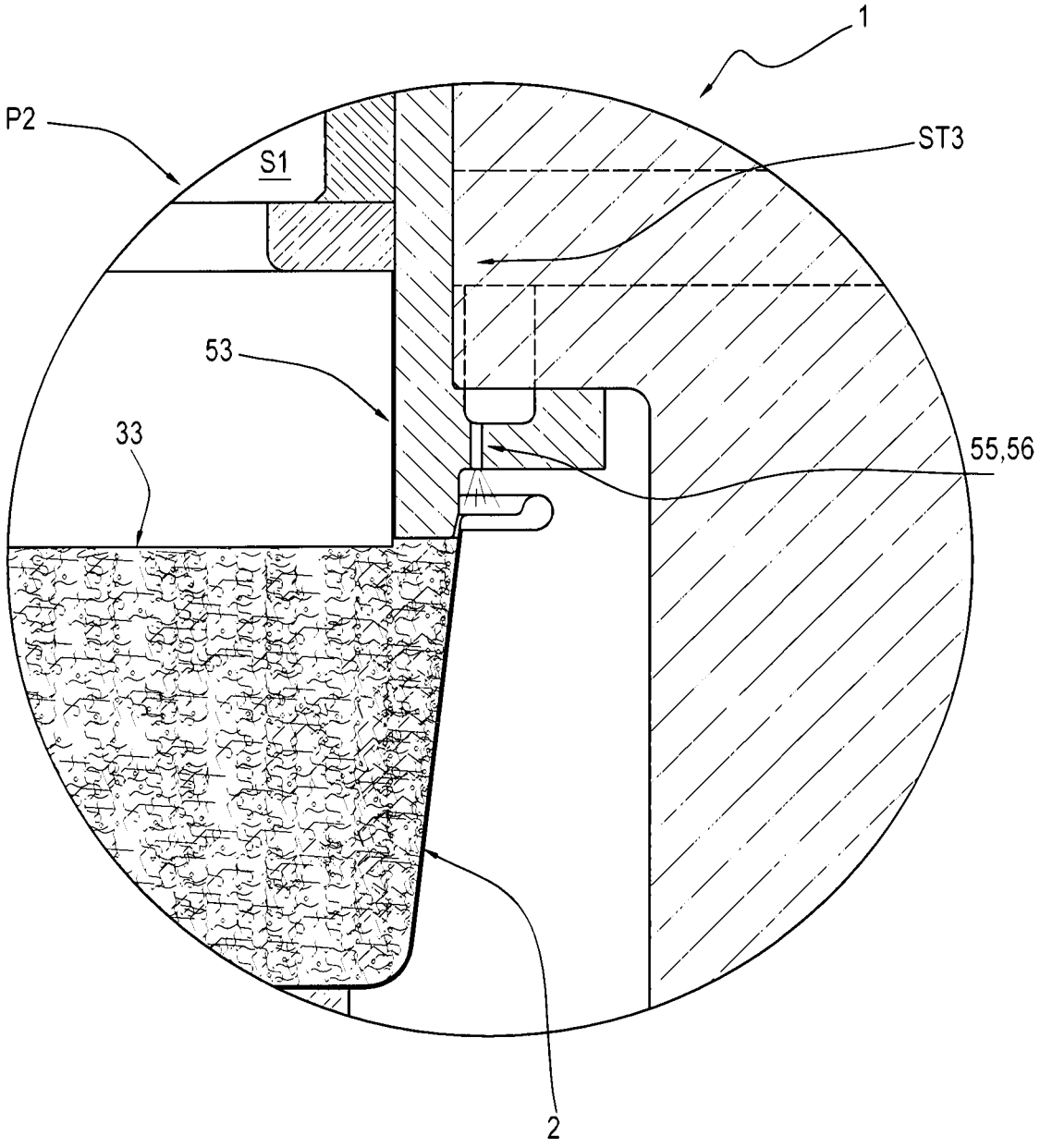
FIG. 9 shows an enlargement of a detail of the filling unit of the preceding figures.
Figure 10:
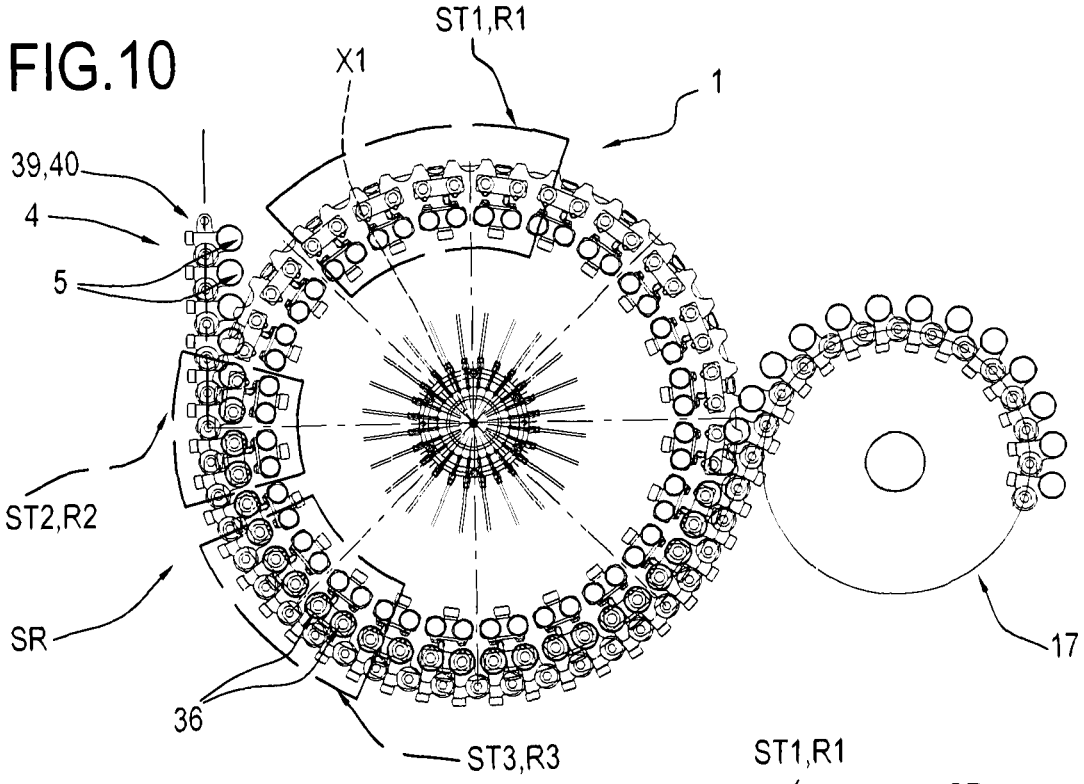
FIGS. 10 and 12 are plan views from above of some components of the filling unit of the preceding figures.

With reference to this aspect, it should be noted that the means 55 for releasing the fluid preferably comprise a nozzle 56 (clearly visible in FIG. 9). Preferably, the nozzle 56 is associated with the tubular element 53. Preferably, at least one nozzle 56 is associated with each tubular element 53.

Advantageously, the fluid release means 55 preferably comprise a source (not illustrated) fluid, such as nitrogen, CO2, other inert gases or air under pressure and a plurality of nozzles 56 in fluid connection with the source, so as to allow the release of pressurised fluid.

After transfer, the lifting piston 23 is moved from the raised position to the lowered position, so as to move the container 2 inside, and resting against, the respective seat 5 of the chain 40.

It should be noted that the filling unit 1 according to this invention is particularly simple in terms of construction and at the same time is extremely flexible, and can easily adapt to different types of products and capsules.

Further embodiments of the filling unit, illustrated in FIGS. 16 to 20, are described below.

With reference to these embodiments, the release device 6 comprises at least one element 40*a*, 40*b* rotating about a respective axis of rotation X4, X5 and having a plurality of blades 60A, 60B, 60C, 60D, 60E, 60F extending away from the axis of rotation X4, X5.

In the embodiments illustrated, the blades 60A, 60B, 60C, 60D, 60E, 60F are positioned tangential to a circle centred on the axis of rotation.

In an embodiment not illustrated, the blades 60A, 60B, 60C, 60D, 60E, 60F are radial blades.

It should be noted that the term radial blades 60A, 60B, 60C, 60D, 60E, 60F means elements protruding in the direction perpendicular to the axis of rotation and positioned to intersect the axis of rotation, configured for moving the product.

Preferably, the feed hopper 38 is positioned above the rotary element 40*a*, 40*b*, so as to feed by dropping the product to the rotary element 40*a*, 40*b*. Moreover, it should be noted that the release device 6 comprises a filling chamber 61 positioned below the rotary element 40*a*, 40*b* and defining a (predetermined) volume for receiving the product.

The above-mentioned rotary element 40*a*, 40*b* is positioned inside a shell 64, the shell 64 being in communication (at the top) with the feed hopper 38 (for receiving the product) and (at the bottom) with the filling chamber 61 (for releasing the product).

Preferably, the shell 64 has a cylindrical internal shape if the release device 6 comprises a single rotary element 40*a*, 40*b*, whilst it has a shape defined by two cylinders if the device 6 comprises a first and a second rotary element 40*a*, 40*b*.

Figure 16:
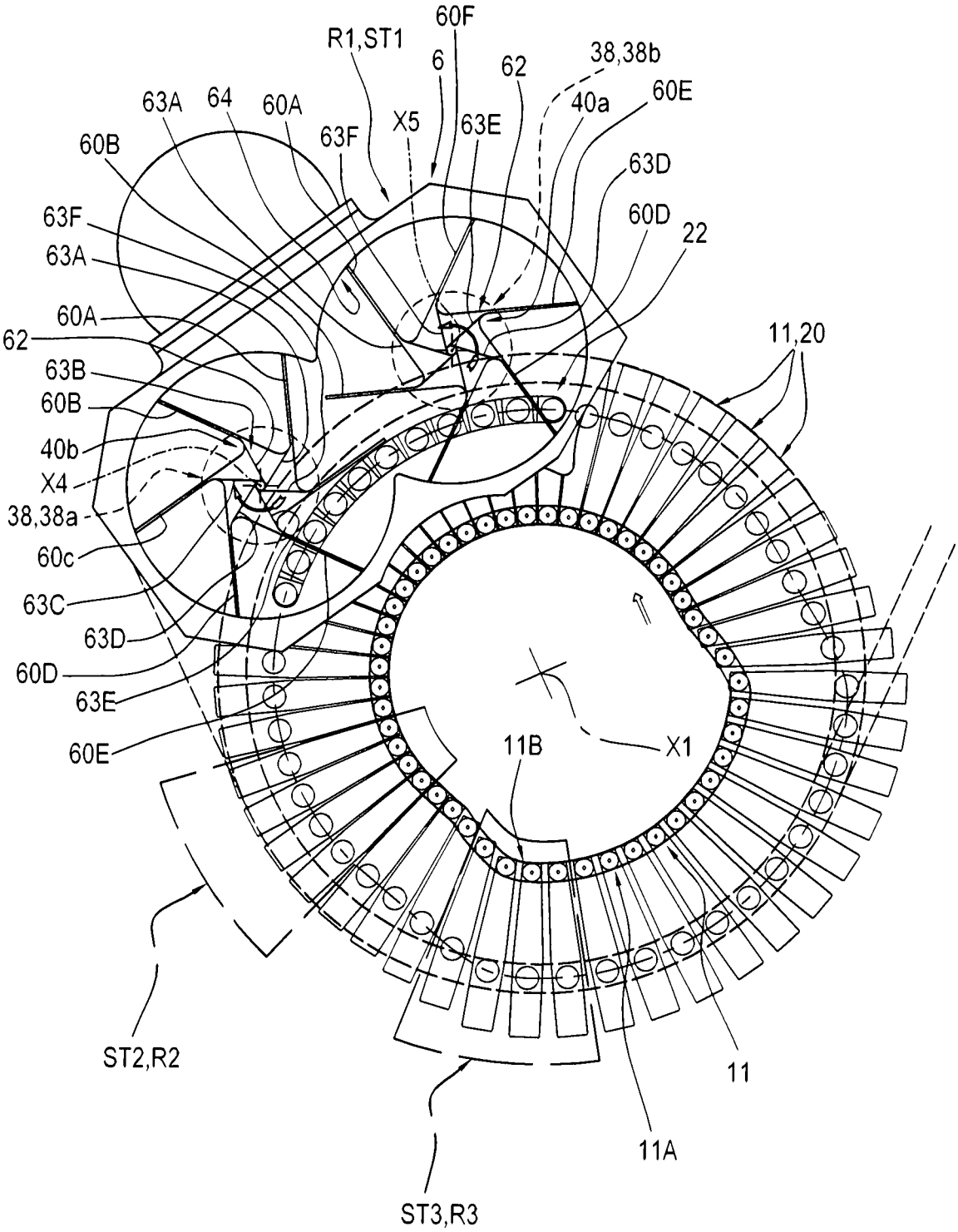
FIG. 16 is a plan view from above of a second embodiment of the filling unit.
Figure 19:
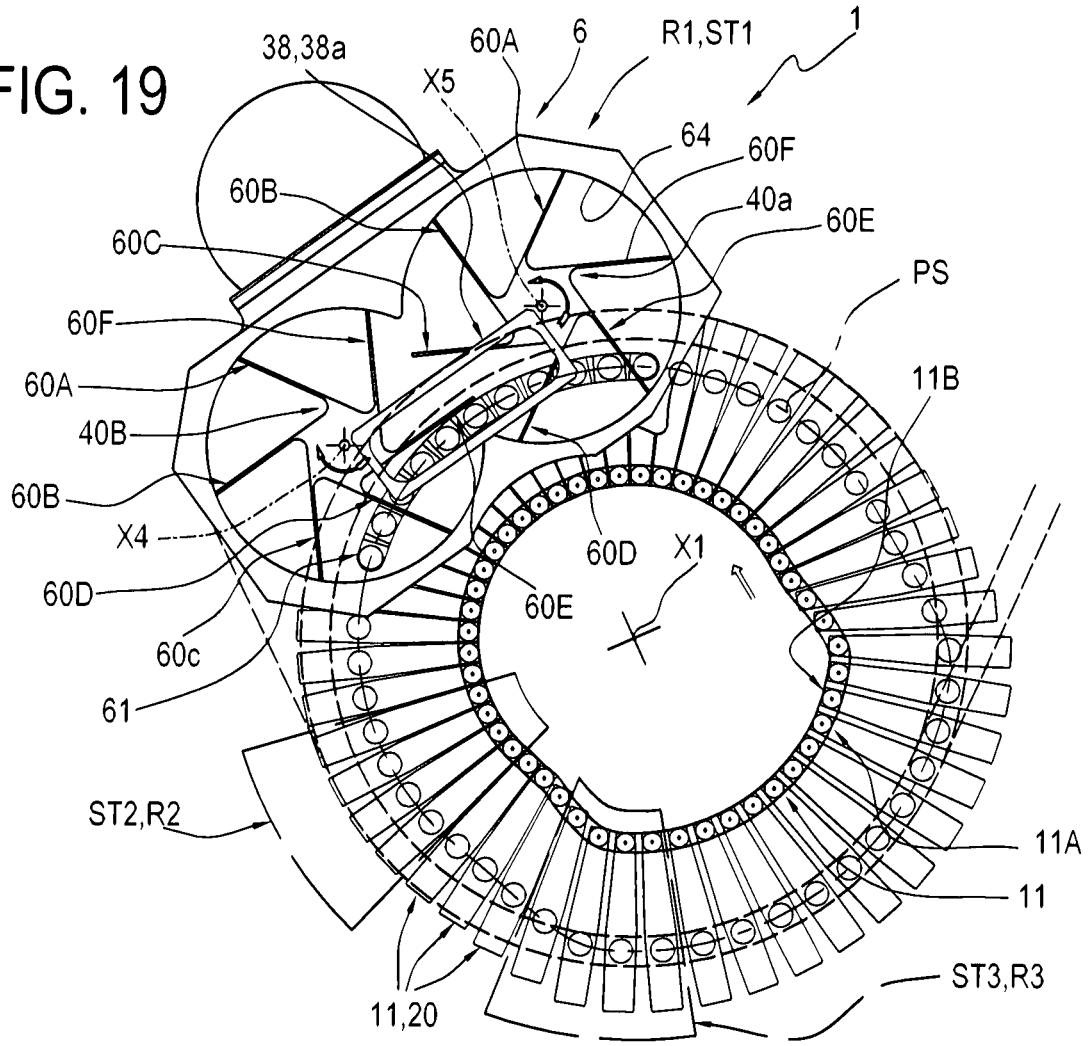
FIG. 19 is a plan view from above of a third embodiment of the filling unit.

If the device 6 comprises a first and a second rotary element 40*a*, 40*b*, the shell 64 has a shape defined by two cylinders, intersecting as in the embodiments of FIGS. 16 and 19, or tangential or separated (not illustrated).

In other embodiments not illustrated, the release device 6 may comprise several rotary elements, in particular more than two rotary elements, each positioned inside a respective shell separated from the others, or inside a shell single, where adjacent rotary elements may be intersecting, or tangential, or spaced apart.

As will be described in more detail below, the filling chamber 61 releases the product inside the at least one first seat S1 at the dose forming region R1.

It should be noted that, according to this embodiment, the rotary element 40*a*, 40*b* is configured for creating a feed flow of product from the feed hopper 38 towards the filling chamber 61.

In other words, the rotary element 40*a*, 40*b* allows the filling chamber 61 to be kept filled with a constant volume of product (equal to the volume defined by the chamber itself), moving (inside the respective shell 64) a flow of product made available (by dropping) from the feed hopper 38.

It should be noted that, preferably, the filling chamber 61 is arc shaped (preferably circular).

Preferably, the filling chamber 61 occupies a portion (arched) of the movement path P1 of the first seats S1.

With reference to the geometry of the filling chamber 61, preferably the first seat S1 has a circular shape, in plan, having a predetermined diameter and the filling chamber 61 has, at least at a lower outlet portion, a width, in plan, substantially equal to the predetermined diameter of the first seat S1.

In this way it should be noted that, in plan, the outlet portion of the filling chamber 61 is superposed perfectly on the first seats S1.

It should be noted that the filling chamber 61, in the preferred embodiment, releases the product at a plurality of first seats S1 positioned temporarily in the region R1, that is to say, opposite below the filling chamber 61.

It should be noted that the release device 6 also comprises drive means (such as, for example, a drive unit), operatively coupled to the relative element, for rotating the rotary element 40*a*, 40*b*.

Figure 18:
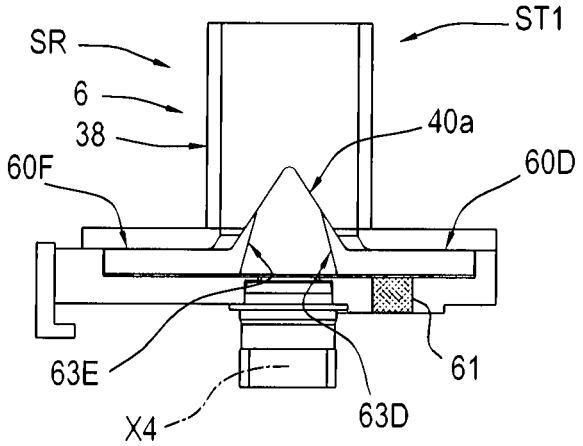
FIG. 18 shows an enlargement of a detail of the filling unit of FIG. 16.

According to another aspect, as illustrated in FIGS. 16 and 18, the at least one rotary element 40*a*, 40*b* comprises an upper portion 62, advantageously tapered for comprising a plurality of protrusions—preferably radial—63*a*, 63*b*, 63*c*, 63D, 63E, 63F for moving the product inside the feed hopper 38.

It should be noted that this upper tapered portion 62 of the rotary element 40*a*, 40*b* has the function of moving the product present in the hopper 38 away from the axis of the rotary element 40*a*, 40*b*, so as to favour the distribution and the descent of product towards the blades 60A, 60B, 60C, 60D, 60E, 60F.

In an embodiment of the invention not illustrated, the portion 62 may have a smooth outside surface, tapered and without protrusions, for example in the shape of a dome or cone.

Figure 17:
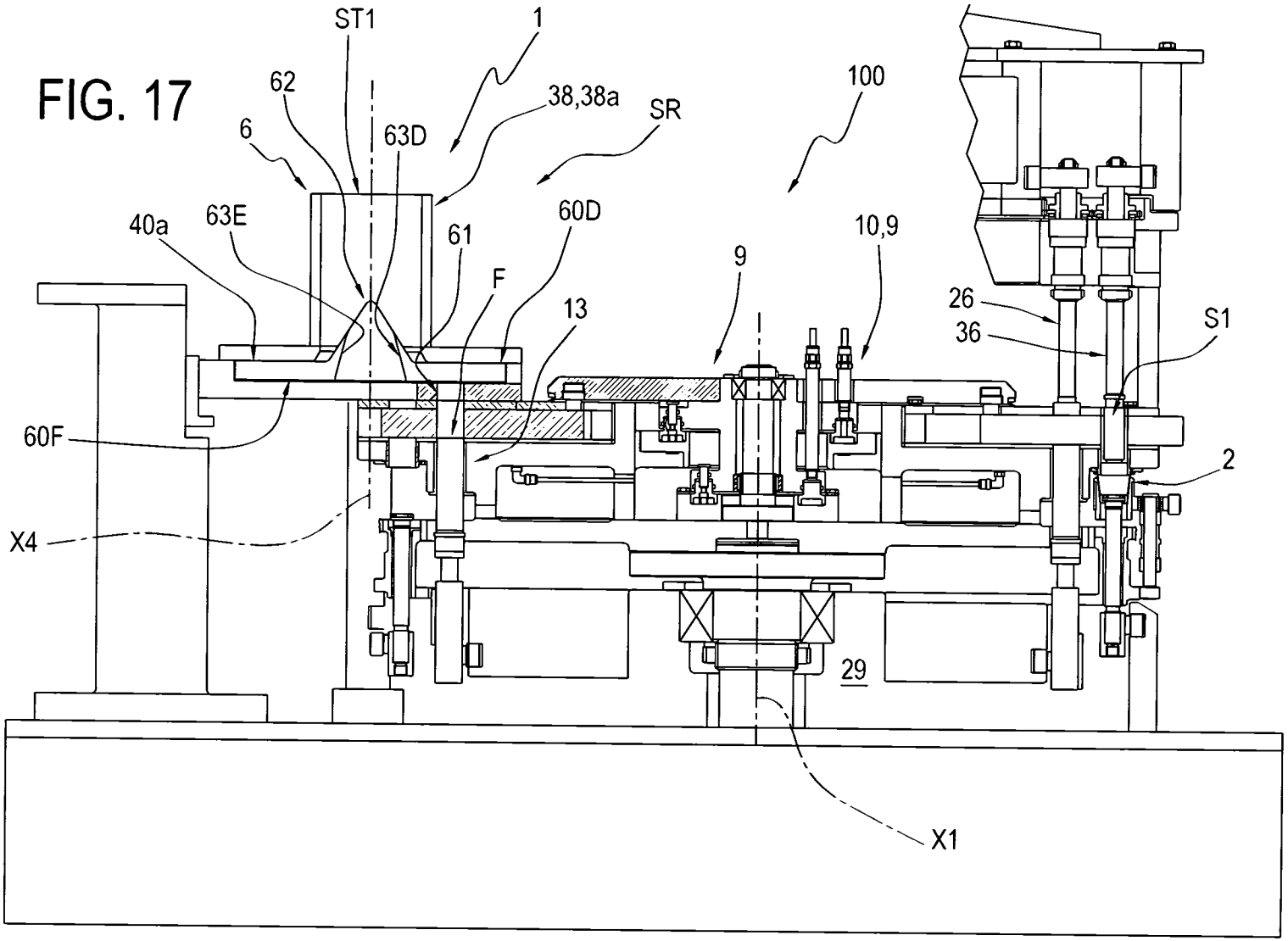
FIG. 17 is a schematic cross section view of a filling station of a filling unit of FIG. 16, with some parts cut away to better illustrate others.

It should be noted that, according to this embodiment illustrated in FIGS. 16 to 18, preferably the axis of rotation X4, X5 of the rotary element 40*a*, 40*b* intercepts the hopper 38.

Preferably, the axis of rotation X4 is vertical.

The axis of rotation X4, X5 of the first rotary element 40*a*, 40*b* is stationary relative to the hopper 38, or equally, to the frame 29.

Figure 20:
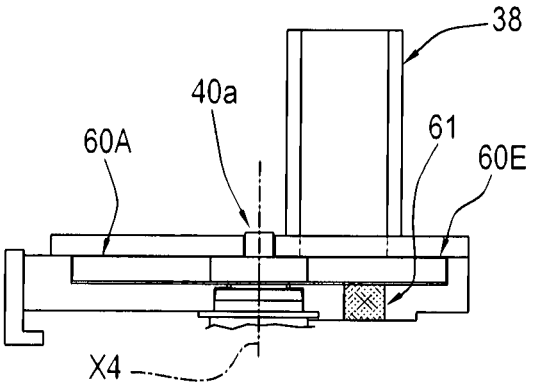
FIG. 20 shows an enlargement of a detail of the filling unit of FIG. 19.

It should be noted that FIGS. 16 to 20 illustrate two embodiments of the release device 6, a first embodiment according to FIGS. 16 to 18 and a second embodiment according FIGS. 19 and 20.

Figure 6:
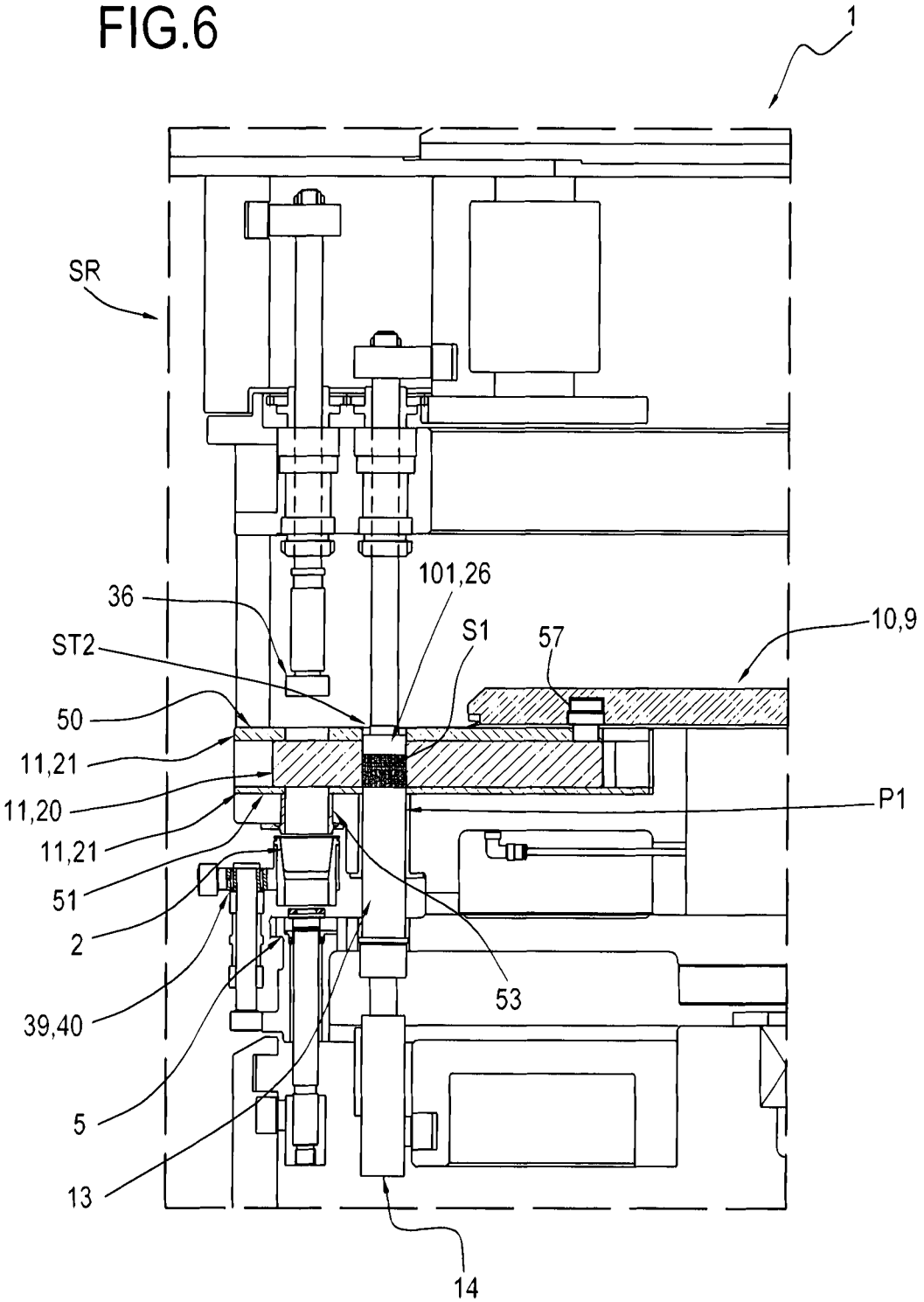
Figure 7:
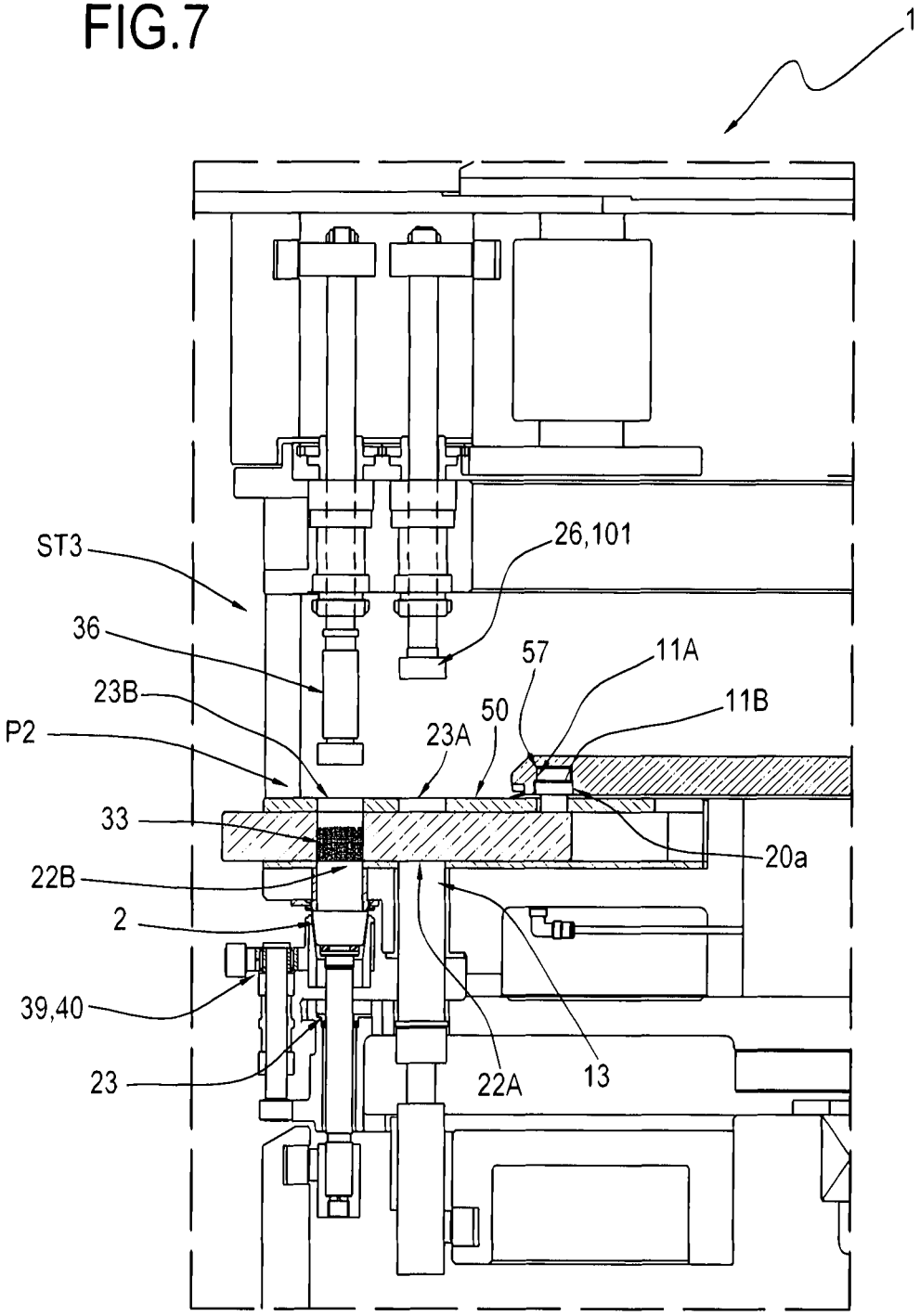
Figure 8:
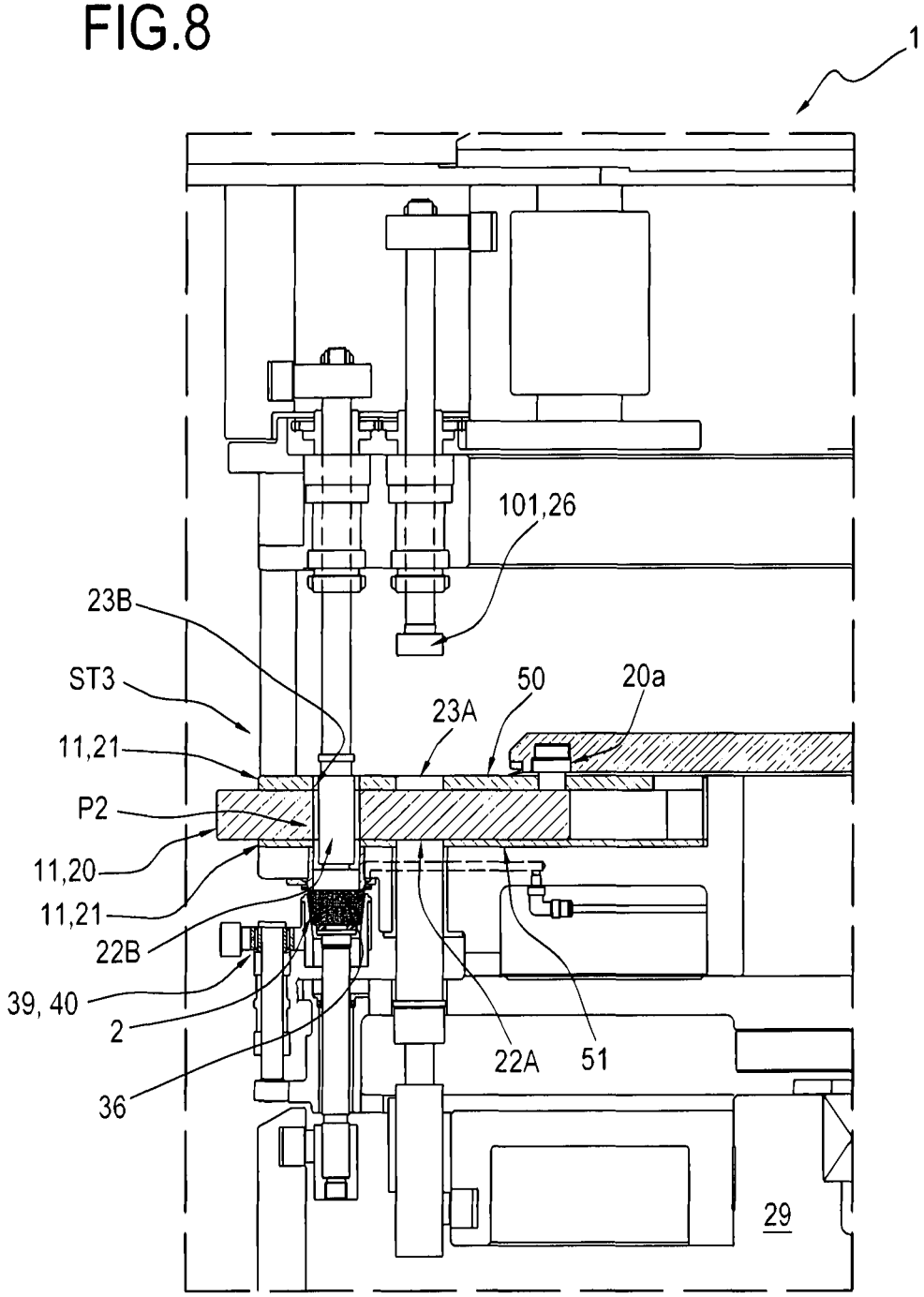
Figure 11:
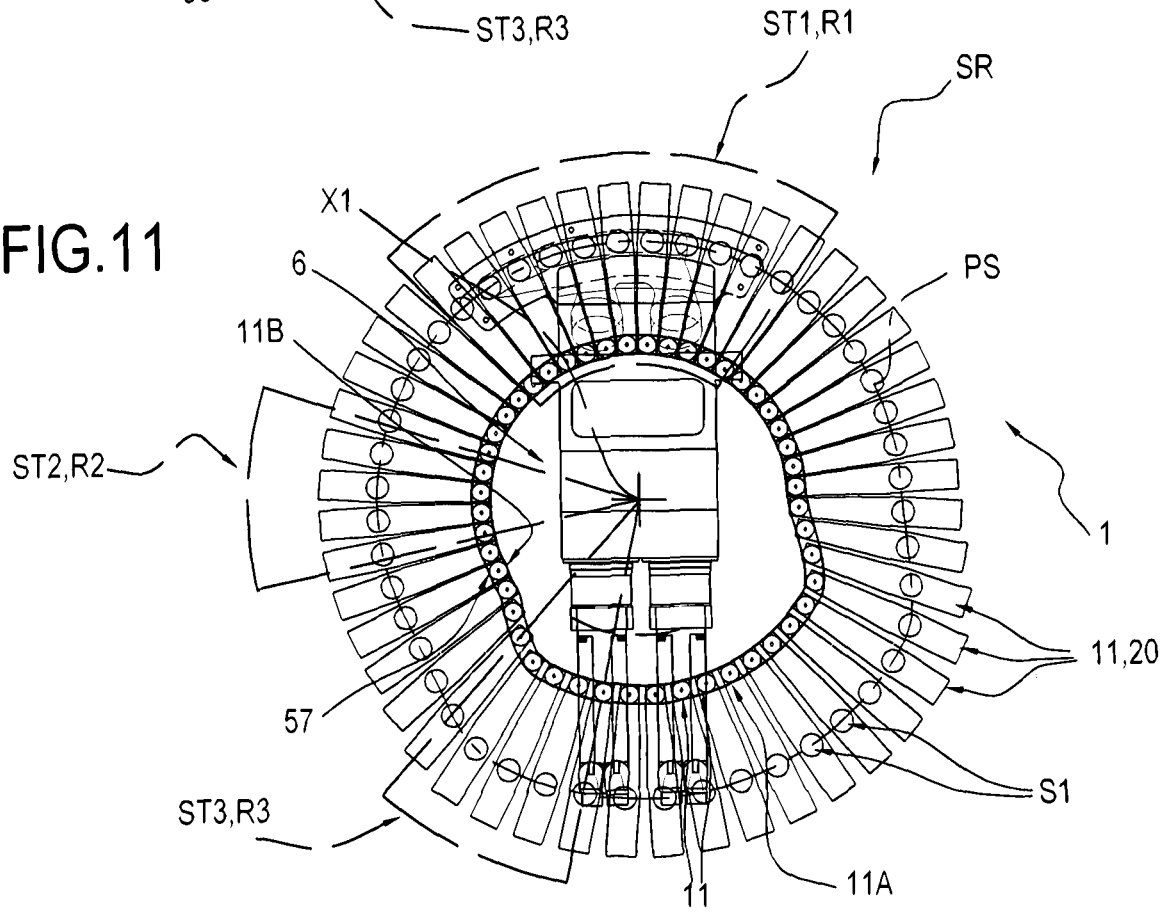

According to both the embodiments illustrated (FIGS. 3, 6 and 14; FIGS. 11, 12 and 13) the release device 6 comprises a first rotary element 40*a* and a second rotary element 40*b* both having a plurality of respective blades 60A, 60B, 60C, 60D, 60E, 60F and acting in conjunction with each other so as to create a feed flow of product from the feed tank(s) 38 towards the filling chamber 61 (to keep the filling chamber filled 61).

According to these embodiments, the first rotary element 40*a* is configured to rotate about a respective first axis X4 of rotation, whilst the second rotary element 40*b* is configured to rotate about a respective second axis X5 of rotation.

Preferably, both the axes X4, X5 of rotation are vertical.

Also, preferably, both the axes X4, X5 of rotation are fixed relative to the frame 29 of the unit 1.

According to an aspect, as illustrated in FIGS. 19 and 20, the release device 6 comprises a single hopper 38 for feeding the product, designed to release the product towards the first and the second rotary element 40*a*, 40*b*.

According to another aspect, as illustrated in FIGS. 16 to 18, the release device 6 comprises a first hopper 38*a* for feeding the product and a second hopper 38*b* for feeding the product, designed to release product respectively towards the first rotary element 40*a* and the second rotary element 40*b*.

More specifically, the first hopper 38*a* for feeding is positioned above the first rotary element 40*a* whilst the second hoper 38*b* for feeding the product is positioned above the second rotary element 40*b*.

More specifically, the first feed hopper 38*a* is positioned relative to the first rotary element 40*a* so that the axis X4 of rotation of the first rotary element 40*a* passes inside the first hopper 38*a*.

Also, the second feed hopper 38*b* is positioned relative to the second rotary element 40*b* so that the axis X5 of rotation of the second rotary element 40*b* passes inside the second hopper 38*b*.

More specifically, as illustrated in FIGS. 16 to 18, both the hoppers 38*a*, 38*b* are cylindrical and positioned coaxially to the axes of the respective rotary elements 40*a*, 40*b*: the first hopper 38*a* is coaxial with the axis X4 of rotation of the first rotary element 40*a* and the second hopper 38*b* is coaxial with the axis X5 of rotation of the second rotary element 40*b*.

It should be noted more in general that the feed hopper 38 may have any geometry: it may have a cylindrical, frusto-conical, parallelepiped shape etc.

With reference to the blades 60A, 60B, 60C, 60D, 60E, 60F of each rotary element 40*a*, 40*b*, the following should be noted.

Preferably, the blades 60A, 60B, 60C, 60D, 60E, 60F are positioned so that a surface with larger planar extension of the blades is parallel relative to a vertical plane.

According to this embodiment, the blades 60A, 60B, 60C, 60D, 60E, 60F move the product according to a substantially horizontal speed component, in particular they apply on the product—due to the effect of their rotation about an axis—a substantially rotary motion.

Preferably, these blades 60A, 60B, 60C, 60D, 60E, 60F have a predetermined extension in height (vertical), so as to act on a predetermined volume of product (preferably cylindrical).

Preferably, these blades 60A, 60B, 60C, 60D, 60E, 60F have surfaces with larger planar extension which are substantially flat.

Alternatively, the blades 60A, 60B, 60C, 60D, 60E, 60F are positioned so that a surface with larger planar extension of the blades is angularly inclined relative to a vertical plane.

With reference to the arrangement of the first and of the second rotary element 40*a*, 40*b*, the following should be noted.

According to the embodiment illustrated in FIGS. 16 to 20, the first and second rotary elements 40*a*, 40*b* are positioned relative to each other in such a way that the trajectory of the blades of one intercepts the trajectory of the blades of the other.

According to this aspect, the first and second rotary elements 40*a*, 40*b* are driven angularly according to a predetermined phase relationship (angular), so as to prevent the blades of the one striking the blades of the other.

Alternatively, according to another aspect, the first and second rotary elements 40*a*, 40*b* are positioned relative to each other in such a way that the trajectory of the blades of the one is different from the trajectory of the blades of the other (that is, in such a way that the trajectory of the blades of the one does not overlap, that is, does not intercept, the trajectory of the blades of the other).

According to yet another aspect, it should be noted that the control unit 15 of the machine 100 is designed to rotate the at least one first rotary element 40*a* of the release device 6 with a speed depending on the speed of movement of the first seat S1 by the first rotary element 9 about the first of rotation axis X1.

Further, according to another aspect of the invention, the control unit 15 of the machine 100 is designed to rotate the at least one first rotary element 40*a* of the release device 6 with variable speed as a function of the quantity of product to be inserted inside each first seat S1. More in detail, it is possible to increase the quantity of product inserted inside each seat by increasing the speed of rotation of the first rotary element 40*a*, in such a way as to increase the apparent density of the product, and vice versa.

In other words, it is possible to vary the quantity of product contained in the first seat S1, and hence in the capsules 3, by adjusting the speed of rotation of the at least one first rotary element 40*a*.

Advantageously, it has been found experimentally that the filling device 6—defined by a rotary element 40*a*, 40*b* with blades—in association the filling chamber 61 allows the variability of the filling of the different first seats S1 to be reduced, evening out the filling of the cup-shaped containers 2 and, therefore, fully satisfying the specifications requested by the manufacturers of capsules.

In effect, the rotary element 40*a*, 40*b* with blades allows the product to be moved by falling from the feed hopper 38 and therefore ensures the filling of the filling chamber 61 under every operating condition.

The filling chamber 61 thus defines a substantially constant volume, which means that the filling pressure (determined by the volume of product inside the chamber) is constant at different points of the same filling region and over time.

It has been found experimentally that the combination of at least one rotary element 40*a*, 40*b* with blades and the underlying filling chamber 61 allows the variability of the quantity of product inserted in seats S1 to be reduced, thereby increasing the repeatability of the filling between the various seats S1, which translates into a greater uniformity of filling the cup-shaped containers/capsules 2.

Described below is a further embodiment of the filling unit, as illustrated in FIG. 21.

According to this embodiment, the release device 6 comprises one or more, for example a pair of, rotary elements 40*a*, 40*b* and a casing 66. The rotary element 40*a*, 40*b* is equipped with a shaft 67, extending along a longitudinal axis X4, X5; the casing 66 extends along the same longitudinal axis X4, X5.

The shaft 67 be is movable along the longitudinal axis X4, X5.

More specifically, the shaft 67 is movable relative to the casing 66 (defined below also as a tubular wrapping 66).

The casing 66 is fixed to the frame 29 of the machine 100 and forms an internal chamber for containing the product to be fed to the seats S1.

It should be noted that the shaft 67 of the rotary element (40*a*, 40*b*) is housed inside the casing 66, at the chamber for containing product to be fed to the seats S1.

The rotary element 40*a*, 40*b*, in particular the shaft 67, is connected movably to the casing 66, that is, to the tubular wrapping 66 (or, equally, to the frame 29), for moving (relative to the casing 66) in a predetermined direction of extension of the longitudinal axis X4, X5.

Preferably, the drive unit 61 of the rotary element 40*a*, 40*b* is also movable (relative to the casing 66) along the longitudinal axis X4, X5 of the rotary element 40*a*, 40*b*, as one with the shaft 67 of the rotary element 40*a*, 40*b*.

For this reason, the drive unit 61 and the shaft 67 are movable as one along the longitudinal axis X4, X5 relative to the casing 66.

It should be noted that the filling device 6 also comprises, according to this aspect, elastic means 60, operatively connected to the casing 66 and to the rotary element 40*a*, 40*b*.

Therefore, it should be noted that the elastic means 60 are operatively interposed between the rotary element 40*a*, 40*b* on one side and the casing 66 on the other, so as to apply a return force on the rotary element 40*a*, 40*b*.

It should also be noted that the elastic means 60 are configured to apply a return force on the rotary element 40*a*, 40*b*, directed mainly along the longitudinal axis X4, X5 towards the first end E1.

More specifically, as shown, the elastic means 60 are compressed following a movement of the first end E1 of the rotary element 40*a*, 40*b* away from the outfeed 19 of the hopper 38 (shift upwards).

For this reason, the deformation (in particular the compression) of the elastic means 60 as a result of movement of the rotary element 40*a*, 40*b* away from the outfeed 19 of the hopper 38 (shift upwards) generates a return force on the rotary element 40*a*, 40*b*, directed along the direction of the longitudinal axis X4, X5 towards the outfeed 19 of the hopper 38.

More specifically, the return force applies a pushing action on the rotary element 40*a*, 40*b* directed towards the outfeed 19 of the hopper 38.

Preferably, the elastic means 60 comprise one or more springs 60A, 60B, interposed between the casing 66 and the rotary element 40*a*, 40*b*.

More specifically, the spring(s) allow the shaft 67 of the rotary element 40*a*, 40*b* to be connected to the casing 66.

Still more specifically, the spring(s) allow the shaft 67 and the drive unit 61 of the rotary element 40*a*, 40*b* to be connected to the casing 66.

As is shown in FIG. 21, the shaft 67 and the drive unit 61 of the rotary element 40*a*, 40*b* are integral with each other and during their movement in an axial direction deform (compress) the springs 60A, 60B.

More specifically, the rotary element 40*a*, 40*b* comprises a plate 62 fixed to the drive unit 61, which is directly active on the springs 60A, 60B and during the movement of the shaft 67 drive unit 61 deforms (compresses) the springs 60A, 60B in the direction of the longitudinal axis X4, X5 of the rotary element 40*a*, 40*b*.

In the embodiment illustrated, each spring 60A, 60B is positioned on the outside of a screw 63A, 63B which is fixed to the casing 66.

Preferably, each spring 60A, 60B is mounted on the screw 63A, 63B so as to abut the head of the screw 63A, 63B at one end and the plate 62 at the other end.

It should be noted that, advantageously, the aspect described above makes it possible to render uniform the filling of the first seats S1.

It has been found that, in effect, in the absence of the elastic means 60 and the possibility of moving the rotary element 40*a*, 40*b* along the longitudinal axis X4, X5, the tip (first end E1) of the helical element forming part of the rotary element 40*a*, 40*b* is subjected to variable pressures, in particular when operated at a constant rotationally speed, due to a non-uniformity in the density of the product between the different seats E1.

The fact of allowing the movement of the rotary element 40*a*, 40*b* longitudinally, and of applying a return force towards a position of equilibrium, allows the creation of a flow of product with a constant pressure at the outfeed from the rotary element.

More specifically, it should be noted that if the pressure on the first end E1 of the helical element of the rotary element 40*a*, 40*b* is greater than a predetermined value (for example, on account of a product blockage close to the outfeed), the rotary element 40*a*, 40*b* moves longitudinally along the longitudinal axis X4, X5 and, consequently, the pressure applied by the rotary element 40*a*, 40*b* towards the outfeed 19 of the hopper 38 is reduced.

In this way, advantageously, the pressure applied by the rotary element (or rotary elements) 40*a*, 40*b* on the product at the outfeed from the hopper 38 is substantially rendered uniform.

The final technical effect is therefore that of filling the first seats S1 with the same quantity of product, that is to say, reducing the variability regarding the quantity of product inserted inside the various seats S1.

It should be noted that, according to this aspect, is also possible to operate the rotary element 40*a*, 40*b* at a variable speed as a function of the angular position of the first end E1 (as described above with reference to FIGS. 13, 14 and 15). For this reason, according to this embodiment, a control unit may also be provided configured to operate the rotary element 40*a*, 40*b* at a variable speed as a function of the angular position of the first end E1 (as described above with reference to FIGS. 13, 14 and 15).

Also defined is a device for releasing product for infusion or extraction beverages, comprising:

- a hopper 38 configured to form a chamber for containing product for infusion or extraction beverages having a casing 66 (or tubular wrapping 66),
- an element 40*a*, 40*b* which rotates about a longitudinal axis X4, X5 positioned inside the casing 66 and designed to be movable along the direction of the longitudinal axis X4, X5 of rotation;
- elastic means 60, operating on the rotary element 40*a*, 40*b* to apply a return force on the rotary element 40*a*, 40*b*, directed mainly along the longitudinal axis X4, X5, to return the rotary element to a predetermined position of equilibrium.

According to this invention, a method is also defined for filling containers forming single-use capsules for extraction or infusion beverages. As stated above, the term "containers" is deemed to mean both rigid, cup-shaped containers 2, of the type shown, and elements for filtration or retention of a dose of product connected to a rigid container.

The method according to the invention comprises the following steps:

- moving a succession of containers 2 along a first movement path P;
- moving at least a containing element (20) comprising a first receiving seat S1 designed to receive a dose 33 of product in rotation about a first axis of rotation X1, in such a way that the first containing seat (S1) moves along a closed path PS;
- creating a dose 33 of product inside the at least one first containing seat S1 at a region R1 for forming the dose located along the closed path PS by releasing product inside the at least one first containing seat S1;
- moving the at least one containing element 20 radially with respect to the first axis of rotation X1, for adjusting the position of the first seat S1 for receiving the product along the closed path PS, between a position P1 for receiving the product at a predetermined region R1 for forming the dose of the closed path PS and a position R2 for releasing the dose in a container 2 at a predetermined region R3 for transferring the dose of the closed path PS;
- transferring the dose 33 of product from the first containing seat S1 to a container 2 at the region R3 for transferring the dose of the closed path PS.

Preferably, the step of releasing a dose 33 of product in a first containing seat S1 in the region R1 for forming the dose 33 of the path PS comprises a step of rotating at least one rotary element 40*a*, 40*b* for releasing the dose 33 of product inside the first containing seat S1.

Preferably, the step of creating the dose 33 comprises a step of releasing inside the at least one first containing seat S1 a portion of a quantity of product accumulated loose in a hopper 38.

Still more preferably, the step of creating the dose comprises a step of releasing product, inside the at least one first containing seat S1, using the pushing action of a screw feeder.

It should be noted that the dose of product (which will be released in a containing seat S1) is created at the region R1 for forming the dose starting from a mass of product, which in terms of quantity—is able to define a plurality of doses 33.

According to the method, the step of moving a succession of containers along a first movement path P preferably comprises moving the containers 2 along a path PS which is a closed loop lying on a horizontal plane.

Preferably, the succession of containers 2 is moved with continuous motion.

Moreover, the step of moving the first containing seat S1 towards the release region R3 comprises a rotation of the first seat S1 about a first vertical axis X1.

Preferably, the step of transferring the dose 33 from the first seat S1 to the container S2 comprises a step of pushing the dose 33 (preferably using an ejection device 36) from the first seat S1 to the container 2.

Preferably, the pushing step comprises making contact with the dose 33 at the top and pushing the dose 33 from the top downwards, for causing the escape from the first seat S1.

According to another aspect, during the step of moving the first seat S1 from the forming region R1 to the release region R3, the method comprises a step of compacting the dose 33 inside the first seat S1.

Preferably, the compacting step comprises abutting the top of the dose 33 (preferably using a compacting element 26) inside the first seat S1.

According to this aspect, the compacting step comprises compressing the dose 33 inside the first seat S1 by the combined action of a compacting element 26, which comes into contact with the top of the dose 33, and a first piston 13 which supports and comes into contact with the bottom of the dose 33. In practice, the dose 33 is compressed between the compacting element 26 and the first piston 13.

More generally speaking, it should be noted that the method comprises a step of compacting the dose 33 inside the first containing seat S1 after the step of releasing a dose 33 of product inside a first seat S1 and before the step of transferring the dose 33 of product from the first containing seat S1 to a container 2.

It should be noted that the step of compacting the dose 33 of product inside the first containing seat S1 comprises a step of preparing a compacting element 26 and a step of moving the compacting element 26 to compress the product inside the first seat S1, so as to compact it.

Alternatively, the step of compacting the dose 33 of product inside the first containing seat S1 comprises a step of preparing the compacting element 26 and a step of moving the first piston 13 towards the compacting element 26, to compress the product inside the first seat S1, so as to compact it.

In a further variant embodiment, the step of compacting the dose 33 of product inside the first containing seat S1 comprises a step of preparing the compacting element 26 and a step of moving both the first piston 13 and the compacting element 26 towards each other, to compress the product inside the first seat S1, so as to compact it.

According to another aspect, the above-mentioned step of adjusting the position of the first seat S1 for receiving the product comprises a step of moving the first seat S1 along a rectilinear direction according to forward and return stroke.

Advantageously, the rectilinear direction lies on a horizontal plane.

More specifically, the step of adjusting the position of the first seat S1 for receiving the product comprises a step of moving the first seat S1 radially relative to the first axis of rotation X1 according to forward and return stroke.

According to another aspect, the step of transferring the dose 33 of product from the first seat S1 to the container 2 comprises a step of preparing the ejection device 36 and a step of moving the ejection device 36 for pushing the dose 33 outside the first seat S1 and releasing the dose 33 inside the container 2.

The method described above is particularly simple and allows the creation of a dose 33 of product and the filling in a fast, clean and reliable manner of a container 2, such as a rigid, cup-shaped container of a single-use capsule 3 for extraction or infusion beverages.

The invention claimed is:

1. A unit for filling containers with a dose of product, comprising:

a line for transporting containers along a movement path and provided with a plurality of supporting seats for the containers arranged in succession along the movement path;

a filling station for filling the containers with a dose of the product;

the filling station comprising:

a containing seat in a containing element and configured to receive a dose of the product;

a movement device configured to move the containing element about a rotational axis for moving the containing seat along a closed path;

an adjusting device configured to move the containing element radially relative to the rotational axis, for adjusting the position of the containing seat between a receiving position for receiving the dose of the product and a releasing position for releasing the dose of the product from the containing seat into one of the containers transported by the transport line;

a forming substation where the dose of the product is formed inside the containing seat, provided with a releasing device for feeding the dose of the product inside the containing seat, when the containing seat is at the receiving position;

a compacting substation where the dose of the product is compacted inside the containing seat, provided with a compacting element movable along a compacting axis, parallel to the rotational axis, between a raised position in which the compacting element is outside the containing seat and a lowered position in which the compacting element is inside the containing seat, the compacting element moving from the raised position to the lower position when the containing seat is at the receiving position; and a releasing substation where the dose of the product is released by an ejection device from the containing seat into said one of the containers transported by the transport line, when the containing seat is positioned in the releasing position, the adjusting device being driven to place the containing seat in the receiving position at the forming substation and in the releasing position at the releasing substation, wherein the forming substation comprises a hopper containing the product and the releasing device extends along a longitudinal axis between a first end cooperating with the containing seat when the containing seat receives the dose of the product and a second end communicating with the hopper for creating a feeding flow of the product from the second end towards the first end, for feeding the product into the containing seat in the receiving position, wherein the longitudinal axis of the releasing device is at an oblique angle of inclination to a horizontal plane, whereby the first and second ends are offset from a common axis which is parallel to the rotational axis; and wherein the compacting substation is located along the closed path between the forming substation and the releasing substation, and the releasing device is removed from the containing seat when the compacting element moves from the raised position to the lowered position, whereby the compacting element does not interfere with the releasing device.

2. The filling unit according to claim 1, wherein the releasing device comprises at least one rotating element configured to rotate about the longitudinal axis.

3. The filling unit according to claim 1, wherein the containing seat is a through seat made in the containing element.

4. The filling unit according to claim 3, comprising a housing configured to slidably house the containing element and having a first upper opening configured and arranged to allow the product to enter the containing seat when positioned at the receiving position, a second upper opening configured and arranged to allow an ejection element to eject the dose of product from the containing seat when positioned at the releasing position, a first lower opening configured and arranged to allow a first piston to form a bottom wall of the containing seat when the containing seat is in the receiving position, and a second lower opening configured and arranged to allow the product to escape from the containing seat when positioned at the releasing position.

5. The filling unit according to claim 4, wherein the adjusting device is configured for placing the containing seat at the first upper and lower openings in the receiving position and at the second upper and lower openings in the releasing position.

6. The filling unit according to claim 1, wherein the releasing device comprises:

at least one rotating element configured to rotate about a respective longitudinal axis and having a plurality of blades extending radially from the respective longitudinal axis;

a filling chamber positioned downstream of the at least one rotating element with respect to flow of the product and defining a volume for receiving the product dose to be released inside the containing seat, the at least one rotating element of the releasing device being configured for creating a feed flow of the product from the hopper towards the filling chamber.

7. The filling unit according claim 6, wherein the at least one rotating element of the releasing device is positioned inside a shell in communication with the hopper and with the filling chamber.

8. The filling unit according to claim 6, wherein the at least one rotating element of the releasing device comprises a first rotary element and a second rotary element having a plurality of respective blades so as to create a feed flow of the product from the hopper towards the filling chamber.

9. The filling unit according to claim 8, wherein the first and second rotary elements are mutually positioned so that a trajectory of the blades of one intercepts a trajectory of the blades of the other.

10. The filling unit according to claim 8, wherein the first and second rotary elements are mutually positioned so that a trajectory of the blades of one is different from a trajectory of the blades of the other.

11. The filling unit according to claim 6, wherein the containing seat has a circular shape, in cross-section, the filling chamber having an outlet portion with a shape, in cross-section, substantially the same as the shape in cross-section of the containing seat.

12. The filling unit according to claim 6, wherein the at least one rotating element comprises an upper tapered portion, having a plurality of protrusions for moving the product inside the hopper.

13. The filling unit according to claim 6, wherein the blades are positioned so that a surface of each blade is angularly inclined relative to a vertical plane.

14. The filling unit according to claim 6, wherein the blades are positioned so that a surface of each blade is parallel relative to a vertical plane.

15. The filling unit according to claim 1, wherein the releasing device comprises at least one rotating element configured to rotate about the longitudinal axis and having a helical profile which extends between the first end and the second end, the longitudinal axis being stationary relative to the hopper.

16. The filling unit according to claim 15, wherein the at least one rotating element of the releasing device comprises:

a first rotary element having a helical profile which extends between the first end and the second end, configured to rotate about a first longitudinal axis of rotation, stationary with respect to the hopper and angularly inclined to a horizontal plane, to create a feeding flow of the product, from the second end towards the first end which intercepts the containing seat, and to release the product inside the containing seat; and a second rotary element having a helical profile which extends between the first end and the second end, configured to rotate about a second longitudinal axis of rotation, stationary with respect to the hopper and angularly inclined to a horizontal plane, to create a feeding flow of the product, from the second end towards the first end which intercepts the containing seat, and to release the product inside the containing seat.

17. The filling unit according to claim 15, comprising a drive and control unit operatively connected to the at least one rotating element of the releasing device and configured to rotate the at least one rotating element at a speed varying as a function of an angle of rotation of the at least one rotating element.

18. The filling unit according to claim 1, wherein the releasing device comprises at least one rotating element and a casing which defines a chamber rotatably housing the at least one rotating element of the releasing device, the at least one rotating element of the releasing device being movable along the longitudinal axis relative to the casing.

19. The filling unit according to claim 18, further comprising elastic means acting on the at least one rotating element of the releasing device and on the casing and configured for applying a force on the at least one rotating element of the releasing device, directed mainly along the longitudinal axis, and towards the hopper.

20. A packaging machine designed for packaging single-use capsules for extraction or infusion beverages, comprising:

a filling unit according to claim 1;

a feeding station designed to feed the containers placed in corresponding supporting seats of the transport line;

a closing station to close the containers with a respective piece of sealing sheet forming capsules; and an outfeed station designed to pick up the capsules from the supporting seats of the transport line.

21. A method for filling containing elements of single-use capsules with a dose of product for extraction or infusion beverages, the method comprising the following steps:

moving a plurality of containers arranged in succession along a movement path;

moving a containing element, comprising a containing seat configured to receive a dose of the product, in rotation about a rotational axis, in such a way that the containing seat moves along a closed path;

feeding a dose of the product inside the containing seat;

moving the containing seat radially relative to the rotational axis for adjusting the position of the containing seat along the closed path, between a receiving position where the dose of the product is fed into the containing seat and a releasing position where the dose of the product is ejected from the containing seat;

compacting the dose of the product inside the containing seat along the closed path, by a compacting element movable along a compacting axis, parallel to the rotational axis, between a raised position in which the compacting element is outside the containing seat and a lowered position in which the compacting element is inside the containing seat, the compacting element moving from the raised position to the lower position when the containing seat is at the receiving position;

transferring the dose of the product from the containing seat into one of the plurality of containers at the releasing position; and wherein the dose of the product is fed into the containing seat by a releasing device having a first end cooperating with the containing seat when the containing seat receives the dose of the product and a second end communicating with a hopper containing the product, the releasing device extending along a longitudinal axis having an angle of inclination oblique to a horizontal plane creating an inclined feeding flow of the product from the second end towards the first end, wherein the releasing device is removed from the containing seat when the compacting element moves from the raised position to the lowered position, whereby the compacting element does not interfere with the releasing device.

22. The method for filling containing elements of single-use capsules according to claim 21, wherein the containers are moved continuously along the movement path.

* * * * *